US012661543B2

(12) United States Patent
Nayak et al.

(10) Patent No.: US 12,661,543 B2
(45) Date of Patent: Jun. 23, 2026

(54) EXERCISE DEVICE CABLE SAFETY LOCKING MECHANISM

(71) Applicant: Podium Fit, Inc., San Francisco, CA (US)

(72) Inventors: Subrat Nayak, San Francisco, CA (US); Adam Ellison, Fitzroy North (AU); Erik Aylen, Bozeman, MT (US)

(73) Assignee: Podium Fit, Inc., San Francisco, CA (US)

( * ) Notice: Subject to any disclaimer, the term of this patent is extended or adjusted under 35 U.S.C. 154(b) by 257 days.

(21) Appl. No.: 18/212,683

(22) Filed: Jun. 21, 2023

(65) Prior Publication Data

US 2025/0288843 A1 Sep. 18, 2025

Related U.S. Application Data

(60) Provisional application No. 63/354,568, filed on Jun. 22, 2022.

(51) Int. Cl.
*A63B 21/00* (2006.01)
*A63B 21/005* (2006.01)

(52) U.S. Cl.
CPC .... *A63B 21/00069* (2013.01); *A63B 21/0052* (2013.01); *A63B 21/153* (2013.01); *A63B 2220/20* (2013.01)

(58) Field of Classification Search
CPC .... A63B 21/0057; A63B 21/005–0052; A63B 21/15–151; A63B 21/153;
(Continued)

(56) References Cited

U.S. PATENT DOCUMENTS 4,055,349 A * 10/1977 Hunt ..... A63B 57/405 377/5
4,564,191 A * 1/1986 Atkin ..... A63B 23/129 482/130

(Continued)

FOREIGN PATENT DOCUMENTS

WO 2022212737 10/2022
WO 2022227499 11/2022

(Continued)

OTHER PUBLICATIONS

"U.S. Appl. No. 17/693,343, Non Final Office Action mailed Oct. 22, 2024", 20 pgs.

(Continued)

*Primary Examiner* — Megan Anderson
*Assistant Examiner* — Kathleen M Fisk
(74) *Attorney, Agent, or Firm* — Schwegman Lundberg & Woessner, P.A.

(57) ABSTRACT

An exercise device comprises a cable, an electromagnetic retraction mechanism for spooling the cable into the exercise device, the electromagnetic retraction mechanism including a shaft, a gear coupled to the shaft, a latch movable between an extended position in which it engages the gear to prevent rotation of the gear in one direction, and a retracted position in which the latch does not engage the gear, an actuator to move the latch to the retracted position when the actuator is powered on, and a spring to move the latch into the extended position when power to the actuator is removed.

13 Claims, 18 Drawing Sheets

(58) Field of Classification Search
CPC ..... A63B 21/157; A63B 69/0048; A62B 1/08; A62B 1/10; A62B 35/0093
See application file for complete search history.

(56) References Cited

U.S. PATENT DOCUMENTS

| | | | | |
|---|---|---|---|---|
| 5,133,545 | A * | 7/1992 | Moschetti | A63B 21/153 482/110 |
| 5,360,382 | A * | 11/1994 | Chi | A63B 21/0058 482/99 |
| 5,645,513 | A | 7/1997 | Haydocy et al. | |
| 5,888,172 | A | 3/1999 | Andrus et al. | |
| 6,293,892 | B1 * | 9/2001 | Slawinski | A63B 21/152 482/4 |
| 6,634,995 | B1 * | 10/2003 | Reed | A63B 23/0233 482/92 |
| 7,374,515 | B2 * | 5/2008 | Slawinski | A63B 21/0783 482/106 |
| 7,556,590 | B2 | 7/2009 | Watterson et al. | |
| 7,648,446 | B2 | 1/2010 | Chiles et al. | |
| 8,900,099 | B1 | 12/2014 | Boyette | |
| 8,968,155 | B2 * | 3/2015 | Bird | A63B 21/156 482/4 |
| 9,327,160 | B2 * | 5/2016 | Tauriainen | A63B 21/0783 |
| 9,539,458 | B1 | 1/2017 | Ross | |
| 12,208,304 | B2 * | 1/2025 | Akeel | A63B 21/00076 |
| 2002/0055424 | A1 | 5/2002 | Brown | |
| 2006/0269251 | A1 | 11/2006 | Hsu | |
| 2008/0051256 | A1 | 2/2008 | Ashby et al. | |
| 2008/0153670 | A1 | 6/2008 | Mckirdy et al. | |
| 2010/0048356 | A1 | 2/2010 | Hamilton | |
| 2010/0069202 | A1 | 3/2010 | Olsen | |
| 2010/0234184 | A1 | 9/2010 | Le et al. | |
| 2011/0082006 | A1 | 4/2011 | Ishii et al. | |
| 2011/0165995 | A1 | 7/2011 | Paulus et al. | |
| 2011/0251021 | A1 | 10/2011 | Zavadsky et al. | |
| 2013/0090216 | A1 * | 4/2013 | Jackson | A63B 21/0442 482/52 |
| 2014/0194250 | A1 | 7/2014 | Reich et al. | |
| 2014/0194251 | A1 | 7/2014 | Reich et al. | |
| 2015/0080184 | A1 | 3/2015 | Boyette | |
| 2016/0256745 | A1 | 9/2016 | Brammer | |
| 2018/0021616 | A1 | 1/2018 | Orady et al. | |
| 2018/0214729 | A1 | 8/2018 | Rubin et al. | |
| 2019/0076691 | A1 | 3/2019 | Smith | |
| 2020/0047030 | A1 | 2/2020 | Ward et al. | |
| 2020/0047031 | A1 | 2/2020 | Orady et al. | |
| 2020/0261771 | A1 | 8/2020 | Belson et al. | |
| 2020/0276465 | A1 | 9/2020 | Orady et al. | |
| 2020/0298049 | A1 | 9/2020 | Valente et al. | |
| 2020/0316424 | A1 | 10/2020 | Orady et al. | |
| 2020/0330847 | A1 | 10/2020 | Orady et al. | |
| 2021/0069553 | A1 | 3/2021 | Belson et al. | |
| 2021/0111646 | A1 | 4/2021 | Rubin | |
| 2021/0128978 | A1 | 5/2021 | Gilstrom et al. | |
| 2021/0170212 | A1 | 6/2021 | Lafrance et al. | |
| 2021/0170213 | A1 | 6/2021 | Orady et al. | |
| 2021/0170214 | A1 | 6/2021 | Orady et al. | |
| 2021/0236876 | A1 | 8/2021 | Gregory | |
| 2021/0291021 | A1 | 9/2021 | Orady et al. | |
| 2021/0379436 | A1 | 12/2021 | Orady et al. | |
| 2021/0394011 | A1 | 12/2021 | Neuhaus et al. | |
| 2021/0394023 | A1 | 12/2021 | Belson et al. | |
| 2022/0001240 | A1 | 1/2022 | Rubin et al. | |
| 2022/0008775 | A1 * | 1/2022 | Rubin | A63B 24/0087 |
| 2022/0032114 | A1 | 2/2022 | Valente et al. | |
| 2022/0184452 | A1 | 6/2022 | Valente et al. | |
| 2023/0201652 | A1 | 6/2023 | Ye | |
| 2023/0226413 | A1 * | 7/2023 | Neuhaus | A63B 71/0622 482/5 |
| 2023/0405404 | A1 | 12/2023 | Belsham et al. | |
| 2024/0082622 | A1 * | 3/2024 | Sherin | A63B 21/025 |
| 2024/0189651 | A1 | 6/2024 | Drayer et al. | |

FOREIGN PATENT DOCUMENTS

| | | |
|---|---|---|
| WO | 2023069724 | 4/2023 |
| WO | 2023102016 | 6/2023 |

OTHER PUBLICATIONS

"U.S. Appl. No. 17/693,343, Response filed Nov. 20, 2024 to Non Final Office Action mailed Oct. 22, 2024", 11 pgs.
"U.S. Appl. No. 17/693,343, Examiner Interview Summary mailed Nov. 25, 2024", 3 pgs.
Toro, David, "Introduction to Brushless DC Motors", Diodes Incorporated, [Online]. Retrieved from the Internet: https: www.diodes.com assets Uploads AN1164-BLDC-Motors.pdf, (May 2021).
"Science—Speede Fitness", https: speede.fit pages science, (Accessed Mar. 4, 2022), 4 pgs.
"Speede—Frequently Asked Questions", https: speede.fit pages faq, (Accessed Mar. 4, 2022), 3 pgs.
"Speediance Works", https: www.speediance.com confirm?id=2, (Accessed Mar. 4, 2022), 5 pgs.

* cited by examiner

EXERCISE DEVICE CABLE SAFETY LOCKING MECHANISM

RELATED APPLICATION DATA

This application claims the benefit of U.S. Provisional Patent Application No. 63/354,568 filed on Jun. 22, 2022, the contents of which are incorporated herein by reference as if explicitly set forth.

TECHNICAL FIELD

This patent application generally relates to the field of exercise equipment. More specifically, this patent application relates to a locking mechanism for a cable-actuated resistance training device that mimics traditional free weights in usage.

BACKGROUND

Exercise is known to be a big enabler of physical and mental well-being. Resistance training, also known as strength or weight training, has significant health benefits, but can also be challenging for a typical person to do correctly or well. Exercising the whole body is good for overall wellbeing, rather than just exercising a few isolated muscles. Compound exercises that engage multiple muscle groups are the most beneficial and time-efficient exercises. Resistance training can also be used for cardiovascular training when done with relatively lower resistance at relatively higher reps over a relatively longer period of time.

There are many known types of exercise equipment for doing cardiovascular training in an indoor setting such as treadmills, stationary spin bikes, rowing machines, stair climbers etc. that have some sort of mechanism to vary the resistance mechanically or magnetically or electro-magnetically.

Resistance training is typically performed by doing body-weight exercises, using free weights, using resistance stretch bands, or using weight-training machines with weights driven through stabilized rigid linkages, or cable machines with weights driven through cables and pulleys, but these suffer from various disadvantages. For body-weight exercises, the resistance doesn't always match the strength of the muscles being engaged. Working with free weights can be potentially hurtful, damaging to the surrounding environment, noisy, or require heavy and expensive safety equipment. Cable machines and weight-training machines require a significant amount of space. While one cable machine can do many different exercise, weight-training machines are usually made for a specific exercise requiring a significant number of different devices to provide a full body workout. Stabilization inherent in weight-training machines can prevent the engagement of all the muscle groups need to stabilize movements under load in real life activities. Resistance stretch bands usually act as linear springs, in which the force increases with extension, so the force is not freely and fully controllable. Some magnetic and flywheel mechanisms exist that can vary the resistance to some extent, but the resistance usually increases with increase in speed of the movement and is thus not sufficiently controllable.

There has been growing interest in exercising at home, instead of commuting to the gym and sharing equipment. Exercise equipment made for the home needs to be affordable, quiet, time-efficient, light weight, portable and space-efficient. It can however be a challenge to stay consistent enough to reap the health benefits. Users can be kept motivated through various digital methods like content and feedback on a digital screen, data logging, progress tracking, live group classes, video communication with a coach and/or other users.

BRIEF DESCRIPTION OF THE SEVERAL VIEWS OF THE DRAWINGS

Some examples of the present disclosure are illustrated by way of example and not limitation in the figures of the accompanying drawings, in which like reference numbers indicate similar elements. To easily identify the discussion of any particular element or act, the most significant digit or digits in a reference number refer to the figure number in which that element is first introduced.

DETAILED DESCRIPTION

Figure 1:
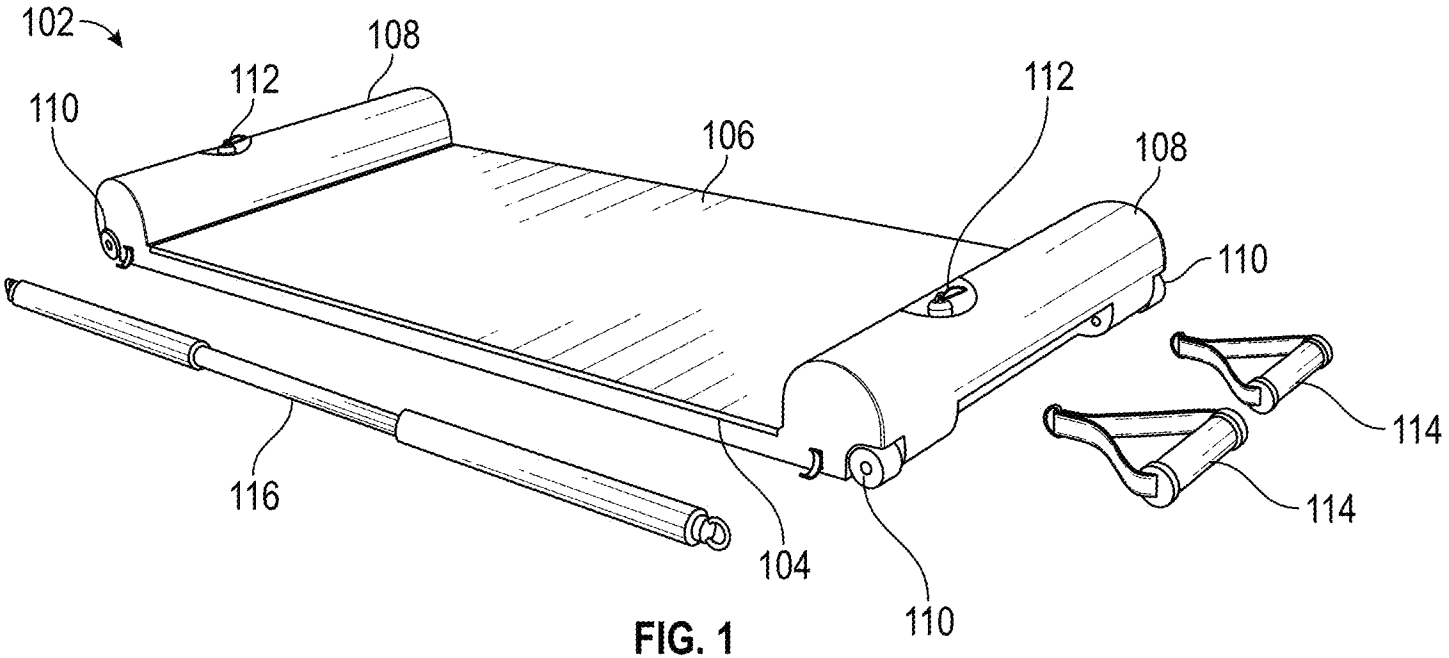
FIG. 1 is a perspective view of an exercise device, according to some examples.

FIG. 1 is a perspective view of an exercise device 102 according to some examples. The exercise device 102 includes a base comprising a chassis 104 and a platform 106, spaced-apart left and right side pods 108, wheels 110, and attachment points 112 to which a workout element, such as handles 114 or a bar 116, can be attached for use in resistance training. The exercise device 102 will typically be placed on the ground, although it can be mounted to the wall or another structure. As will be described in more detail below, the attachment points 112 are coupled to two cables 202 that are housed in the side pods 108.

Figure 3A:
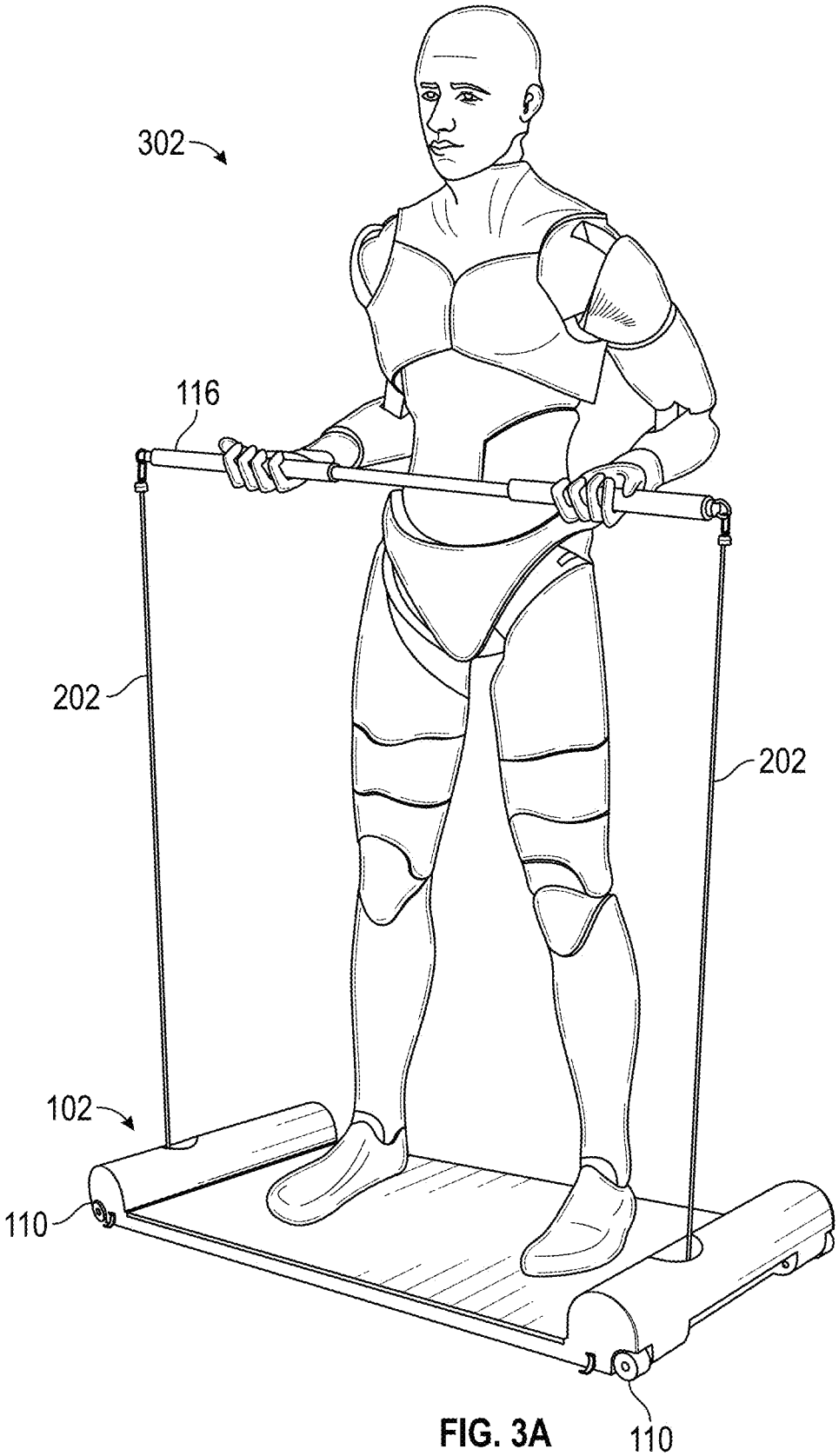
FIG. 3A, FIG. 3B and FIG. 3C illustrate strength exercises that can be performed using the exercise device according to some examples.
Figure 3B:
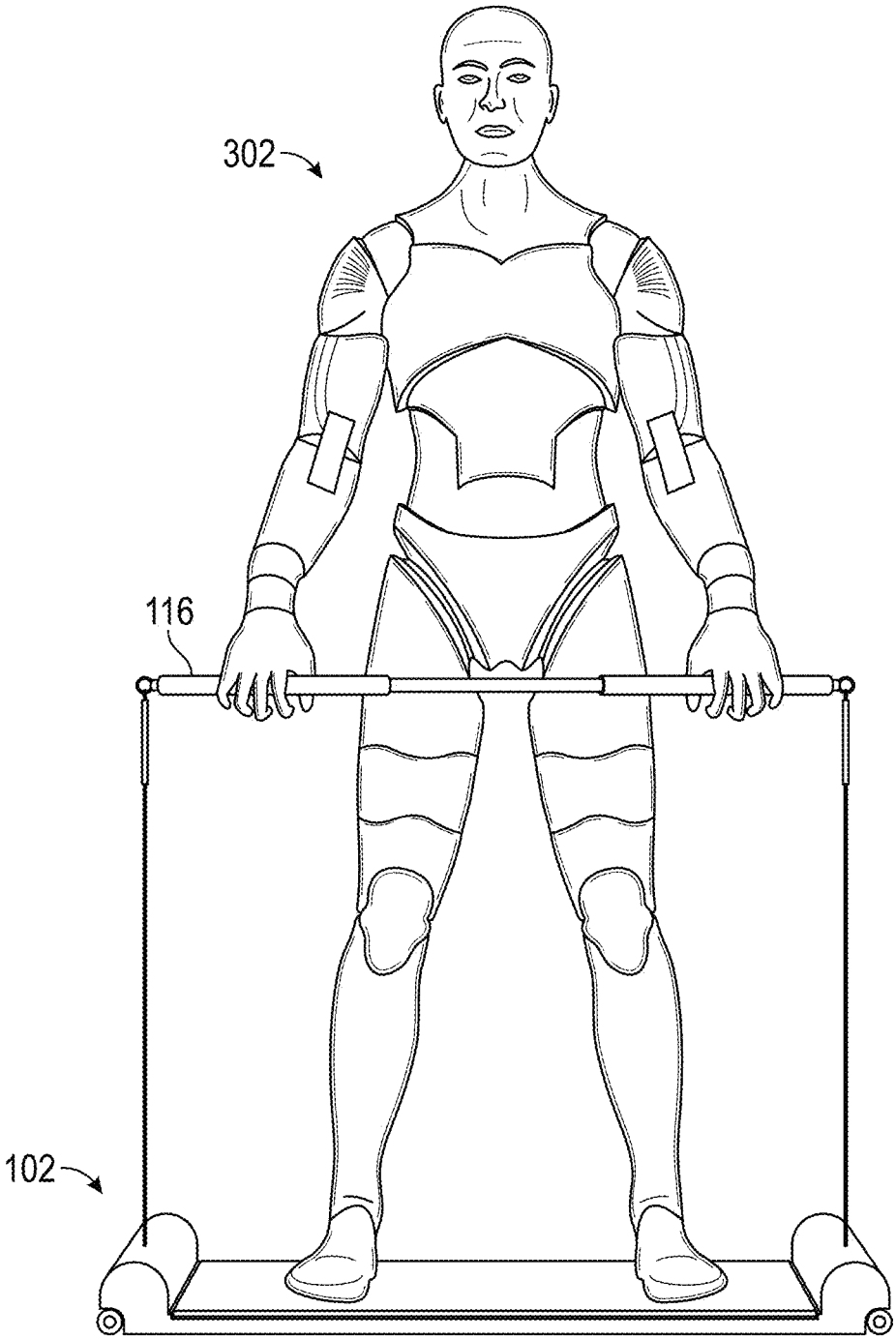
Figure 3C:
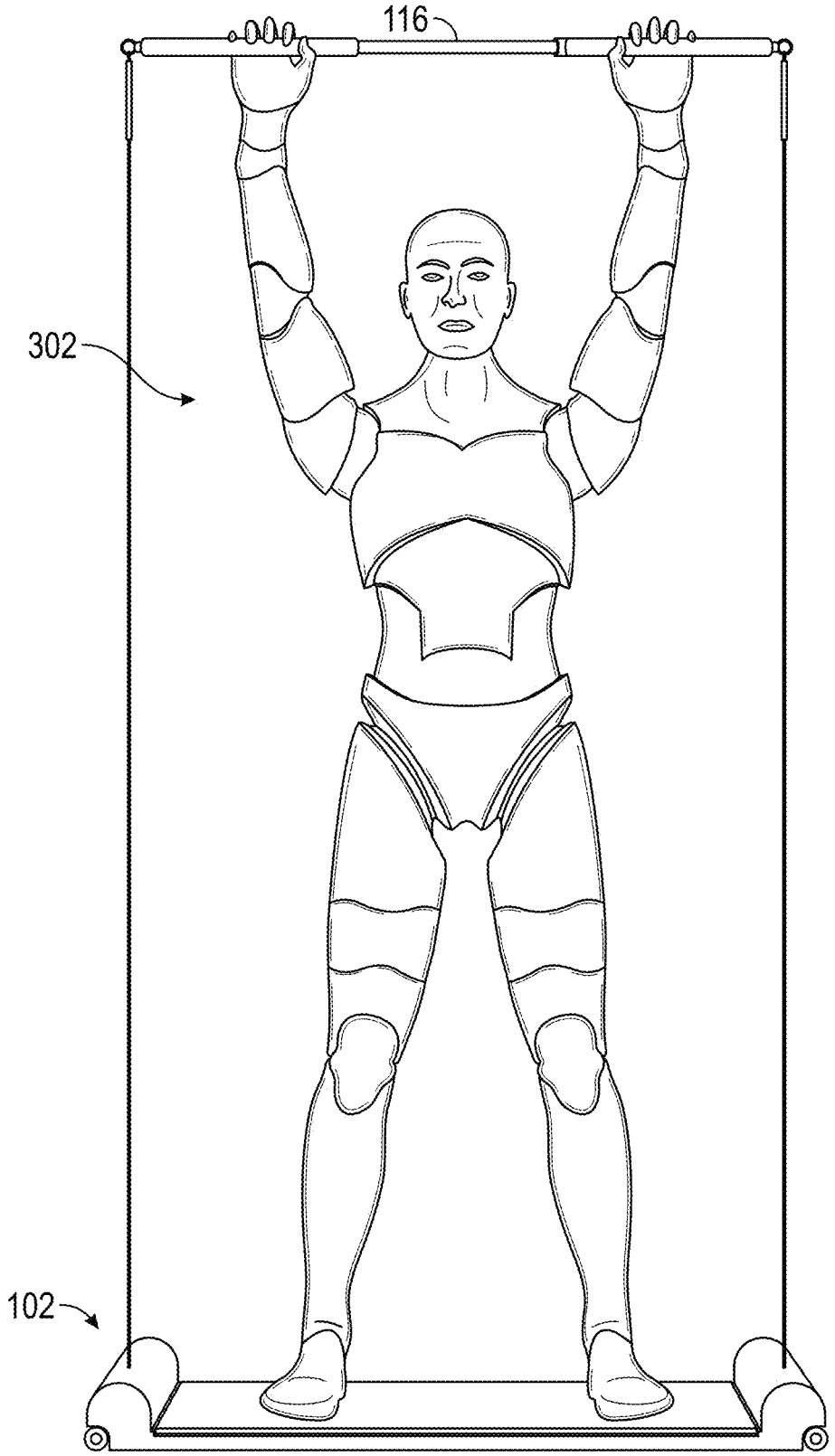

The top of the platform 106 is planar and fairly low in height (in the range of 2-3 inches) when the exercise device 102 is on the ground, which mitigates any risk or fear of falling off of a high step during exercise and makes the exercise device 102 safer. A user can stand, sit, kneel, or lie on the platform 106 depending on the exercise, with the user's weight holding the exercise device 102 down while the user lifts in an upward direction using the bar 116 or the handles 114 as shown in FIG. 3A, FIG. 3B and FIG. 3C. Additionally, since the bar 116 overlaps the side pods 108 on both sides, if a user drops the bar 116 it will hit the side pods 108 before it hits the user's feet.

The chassis 104 is supported by wheels 110. There may be two wheels 110 on just one side so that the exercise device 102 can be picked up from the other side to engage the wheels 110, which permits the exercise device 102 to be moved into and out of storage like a rolling suitcase, without having to lift the full weight of the exercise device 102. In other examples, the device may have four wheels 110 (two on each side as shown in FIG. 1). In some cases, the wheels do not extend below the bottom of the chassis 104 and require that a side of the exercise device 102 be lifted up on one side to engage the wheels on another side.

In other examples, the wheels 110 are spring-loaded and protrude below the chassis 104 when the exercise device 102 is not in use, but are pushed up into the chassis 104 when a certain minimum weight of the user rests on the platform 106, which ensures that the exercise device 102 is securely engaged with the ground when used. This provision of wheels 110 permits the exercise device 102 to be rolled away conveniently, for storage under a bed or couch for example.

In the case of spring-loaded wheels 110, one or more of the wheels 110 may be attached to a sensor to detect whether it or they are pushed up into the chassis by the user's weight. Detection of these two states of the wheels 110 may be used to enable full functioning of the exercise device 102 when the wheels are retracted and to disable full functioning of the exercise device 102 when the wheels are extended. In particular, the exercise device 102 can use these two states to disable tension in the cables provided by the motors 512 (see FIG. 5) when the user's weight is not on the platform, so that if the user steps off the platform 106 during an exercise or is not on the platform when a handle 114 or the bar 116 is lifted, the platform 106 will not be lifted into the air under the power of the motors. Alternatively, sensors could be provided in the platform 106 or elsewhere to detect the user's weight, to enable or disable functioning of at least the motors 512 based on detecting the presence or absence of the user's weight.

In other examples, the wheels 110 on one or both of the sides may be casters, or there may be a single caster wheel on one side and two normal wheels on the other side. Providing at least one caster wheel allows the user to rotate the exercise device 102 while on the ground, which helps in moving the exercise device 102 under beds and couches that may have little clearance under them.

Figure 2A:
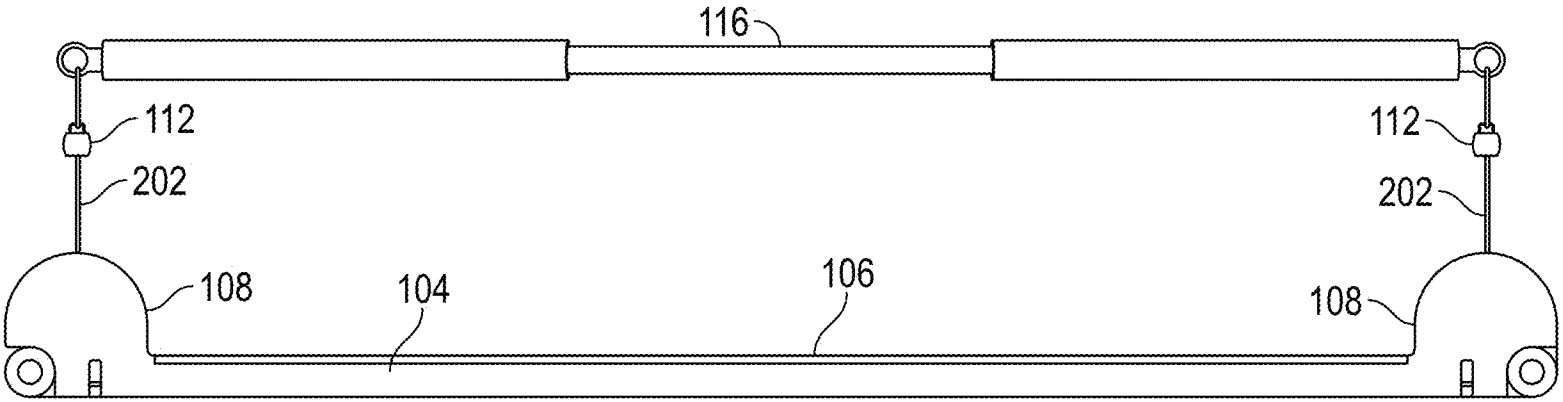
FIG. 2A and FIG. 2B show two configurations of the exercise device in use, according to some examples.
Figure 2B:
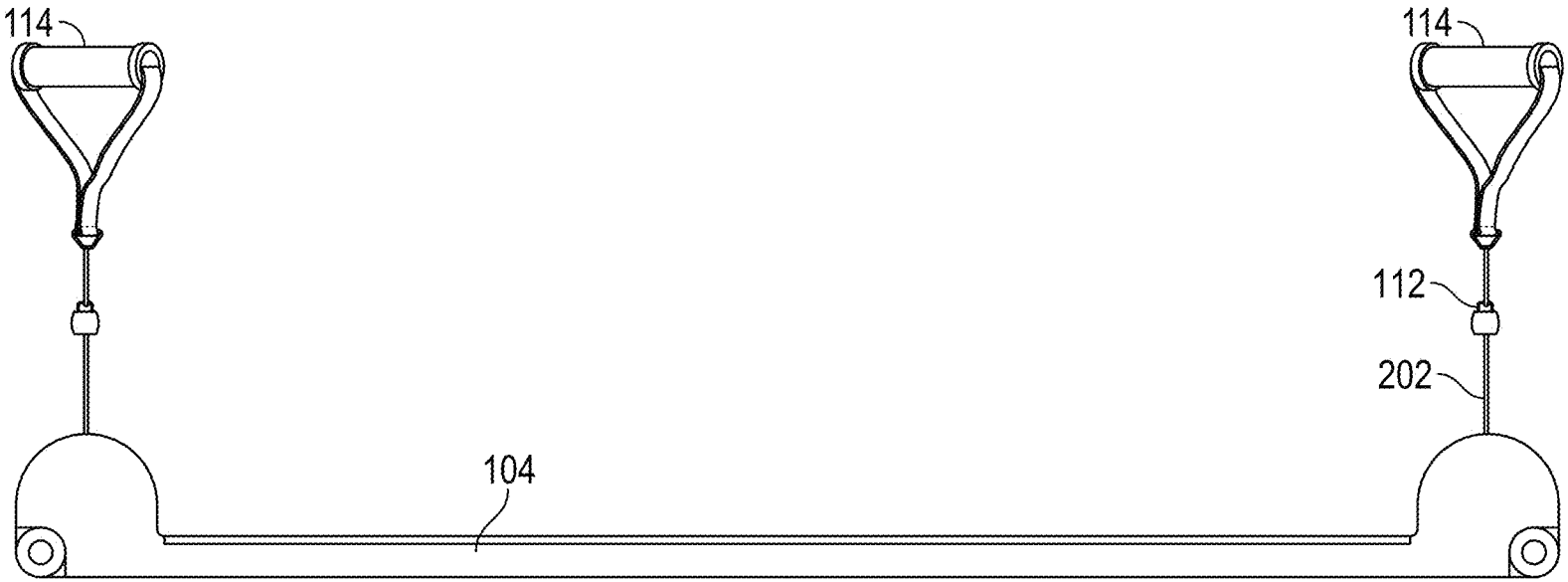

FIG. 2A and FIG. 2B show two configurations of the exercise device 102 in use, according to some examples. As shown in FIG. 2A and FIG. 2B, by attaching the bar 116 or the handles 114 to the attachment points 112, the cables 202 can be pulled up vertically or at a certain angle from vertical, under tension that is provided by two motors, one in each side pod 108. The tension in in each cable 202 provides the resistance for the training. The exercise device 102 is designed to mimic free weights like barbells, dumbbells, and so forth.

As shown in FIG. 2A, when the bar 116 is attached to the cables 202, a user can train as if the bar 116 is a barbell. Or, as shown in FIG. 2B, when the two handles 114 are attached to the attachment points 112, they can act independently to be used to train like two dumbbells. Other attachments may also be provided, like a short bar with one attachment point in the middle, a waist belt with two attachments on each side, an ankle/wrist strap with one attachment point, and so forth, can also be used to connect to one or both of the attachment points 112 to provide a variety of different workouts.

Hundreds of different exercises can be done to create a full-body workout using a barbell and two dumbbells. Accordingly, the exercise device 102 can be used to do many different exercise for full body resistance training. Since the two cables 202 can operate independently and with different tension forces, which can also vary dynamically, a user can do many different balance and stabilization resistance exercises with the exercise device 102 as well.

FIG. 3A (bicep curls), FIG. 3B (deadlift) and FIG. 3C (overhead press) illustrate three different strength exercises that can be performed by a user 302, using the exercise device 102 according to some examples.

Figure 4A:
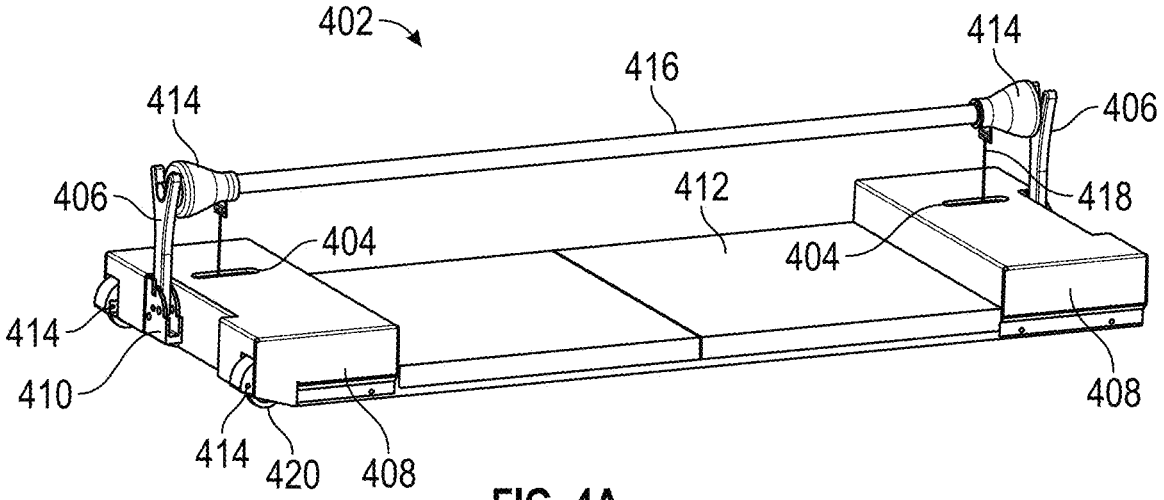
FIG. 4A and FIG. 4B show two configurations of a second version of the exercise device, according to some examples.
Figure 4B:
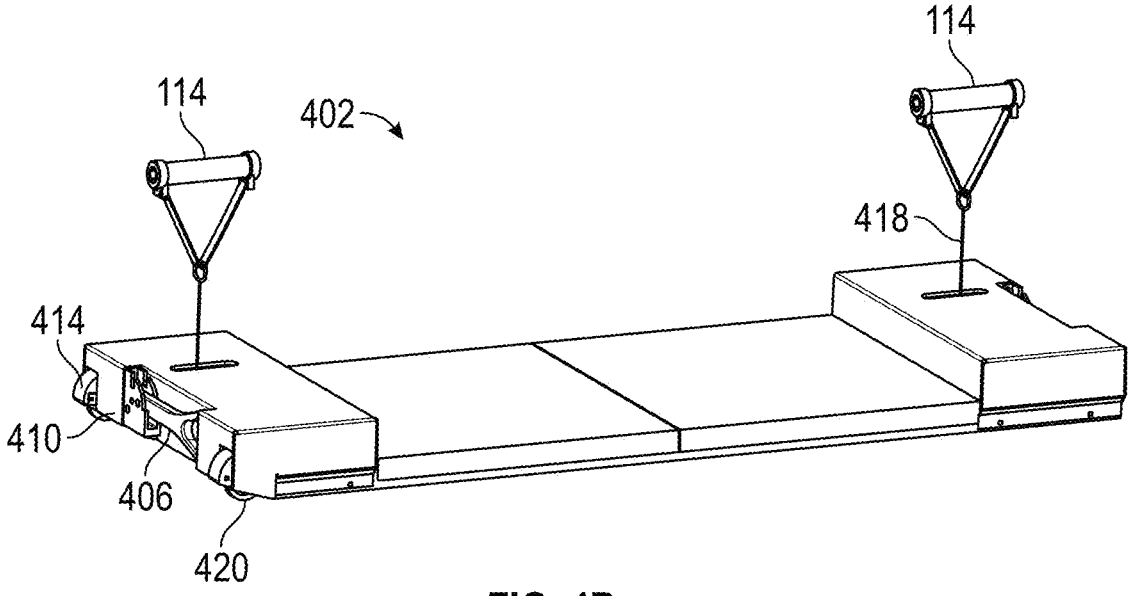

FIG. 4A and FIG. 4B show two configurations of a second version of the exercise device, according to some examples. The exercise device 402 in this case has rectangular side pods 408. Each side pod 408 has a slot 404 defined therein that permits side-to-side movement of each cable 418 in use. A Y-shaped bar holder 406 is rotatably coupled to each side pod 408 by means of a bracket 410. The bar holders 406, when in the vertical position shown in FIG. 4A, hold a bar 416 at a defined height above the platform 412, which makes it easier for the user to place their feet in alignment under the bar 416, as well as to permit more convenient grasping of the bar without having to lean all the way down to pick the bar off the platform or off the side pods 408. A user can break form if they need to lean all the way down to the pick the bar 416 up off the platform 412, which may lead to injury over a period of time.

Foot position relative to the points at which the cables 418 exit the side pods 408 is important for optimal form and to reduce the risk of injury. For example, if the bar 416 had to be picked from the platform 412, a user would not have room to locate their foot right under the bar 416 initially, which would make them stand further backwards on the platform next to the bar 416. This would either require the user to move forward after the bar 416 had been raised, or do the exercise with feet not in an optimal position, which will in turn cause the user to do the exercise in a nonoptimal form.

As shown in FIG. 4B, the bar holders 406 can be rotated out of the way to a horizontal position adjacent to the side pods 408 to facilitate unobstructed use of the handles 114 with the exercise devices 402.

Also shown in FIG. 4A and FIG. 4B are stops 414 above the wheels 420 on the side pod 408 on the left side, to assist with moving and storage of the exercise device 402.

Figure 5:
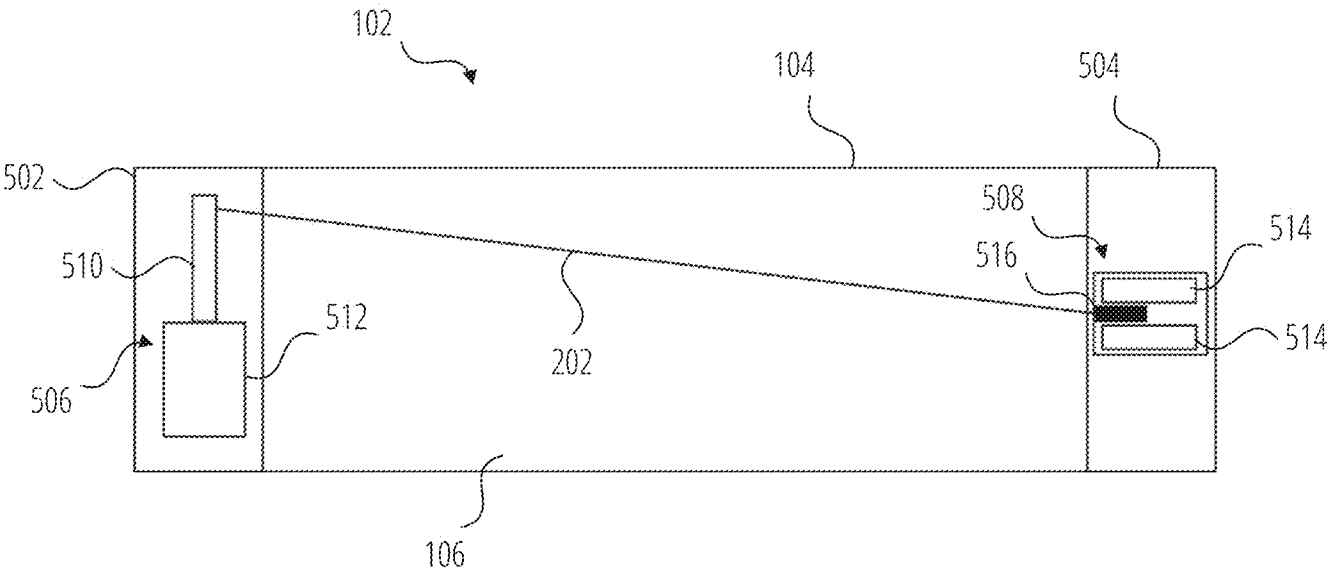
FIG. 5 illustrates the arrangement of components inside the exercise device to provide cable tension and management according to some examples.

FIG. 5 illustrates the arrangement of components inside the exercise device 102 to provide cable tension and management according to some examples. FIG. 5. is a schematic top view of the exercise device 102 showing the position of a retraction mechanism 506 in a left side pod 502 and a cable guide 508 in the right side pod 504. For purposes of clarity, the components are only described with reference to the cable 202 that exits the right side pod 504. It will be appreciated that the arrangement of the illustrated components is mirrored for the cable that exits the left side pod 502, but with the retraction mechanism in the right side pod 504 facing in the opposite direction so that the cables crisscross underneath the platform with a small clearance between the cables and an underside of the platform. This configuration of retraction mechanisms 506 and cable guides 508 in opposite side pods with the cables passing in opposite directions allows a low platform height, which just needs to be sufficiently high to allow adequate cable clearance.

An example of the cable guide 508 is described in more detail below with reference to FIG. 6, FIG. 7, and FIG. 8, while an example of the retraction mechanisms 506 is described in more detail below with reference to FIG. 9 and FIG. 10.

The retraction mechanism 506 includes an electric motor 512 and a directly coupled long tubular threaded spool 510 onto which the cable 202 winds and unwinds in use of the exercise device 102, under torque that is applied to the threaded spool 510 by the motor 512. The cable 202 passes through the chassis 104 under the platform 106 from the threaded spool 510 to the cable guide 508. The spool is a zero-backlash mechanism to convert torque to tension, which may sometimes be powered manually or by an electric motor. An electric motor can also be called an electro-magnetic mechanism that uses electricity and magnetism to create torque.

The cable guide 508 in turn comprises a pulley 516 that receives the cable 202 from the retraction mechanism 506 and guides it upwards so that it is oriented generally vertically and can be attached via its attachment point 112 (not shown) to a handle 114 or the bar 116. Also provided are two rollers 514 that permit movement of the cable in a forward or backward direction (up or down in FIG. 5) relative to the platform 106.

Figure 6:
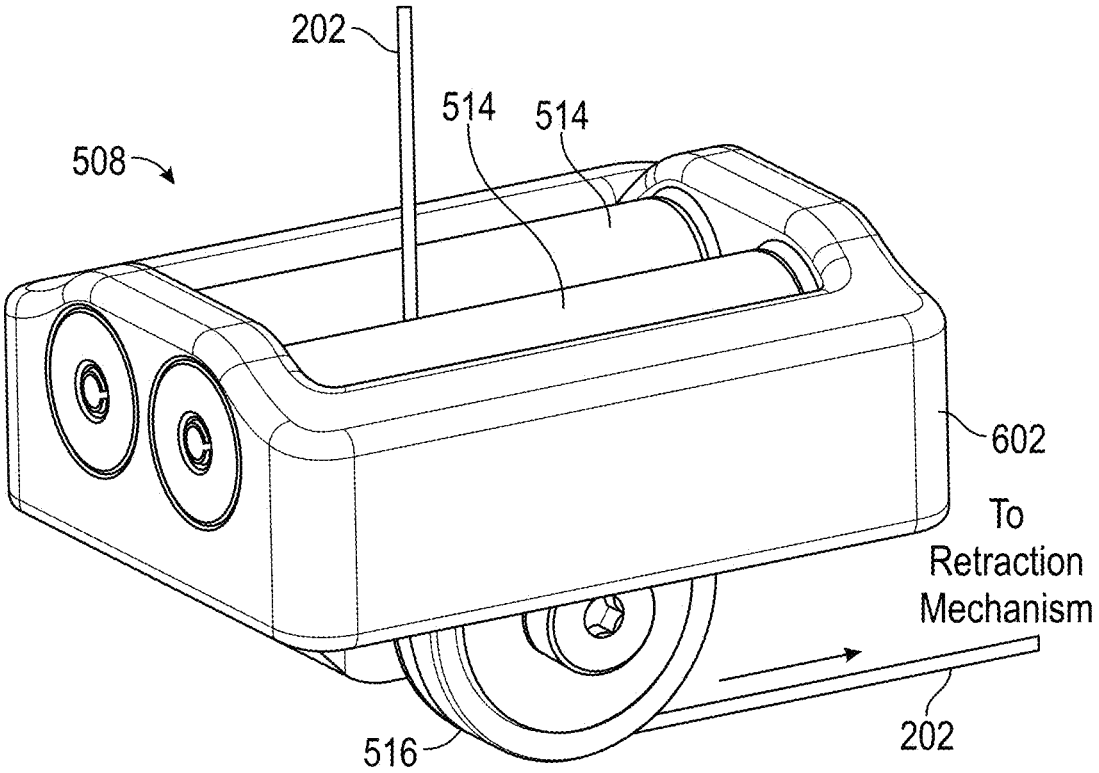
FIG. 6 is a perspective view of the cable guide of FIG. 5 according to some examples.

FIG. 6 is a perspective view of the cable guide 508 of FIG. 5 according to some examples. The cable guide 508 includes a housing 602 within which the two rollers 514 are rotationally mounted with the cable 202 exiting the housing 602 between the rollers 514. Below the housing, the pulley 516 receives the cable from the direction of the retraction mechanism 506 and turns it upward towards the attachment point 112 (not shown) where it can be attached to a bar 116 or a handle 114. The rollers 514 and the pulleys 516 are mounted to the housing using sealed ball bearings to provide quiet and low-friction movement of the cable 202. The elongated rollers 514 are parallel to each other and oriented in a direction across the exercise device 102 with a gap between them through which the cable passes. The pulley 516 is located underneath the gap between the rollers 514.

Figure 7:
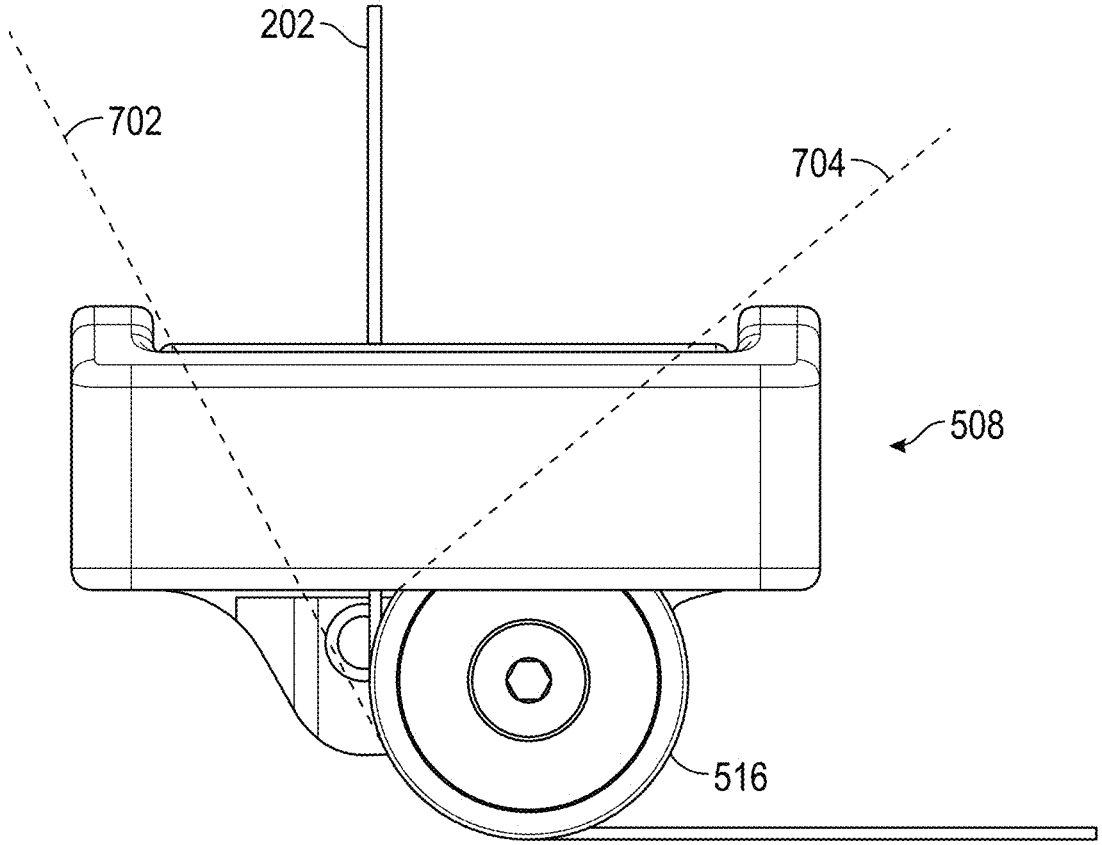
FIG. 7 is a front view of the cable guide of FIG. 5 according to some examples.

FIG. 7 is a front view of the cable guide 508 of FIG. 5 according to some examples. As can be seen, the arrangement of the rollers 514 and the pulley 516 permit functional side-to-side movement of the cable 202 between an outer limit 702 and an inner limit 704 within which the movement of the cable 202 does not interfere with the housing 602. The pulley 516 is positioned such that the vertical exit point of the cable 202 from the housing is offset to towards the outside of the exercise device 102 (away from the platform 106) so that the angle between vertical and the inner limit 704 is greater than the angle between vertical and the outer limit 702, since in use the handles 114 are likely to extend further over the platform 106 than away therefrom.

Figure 8:
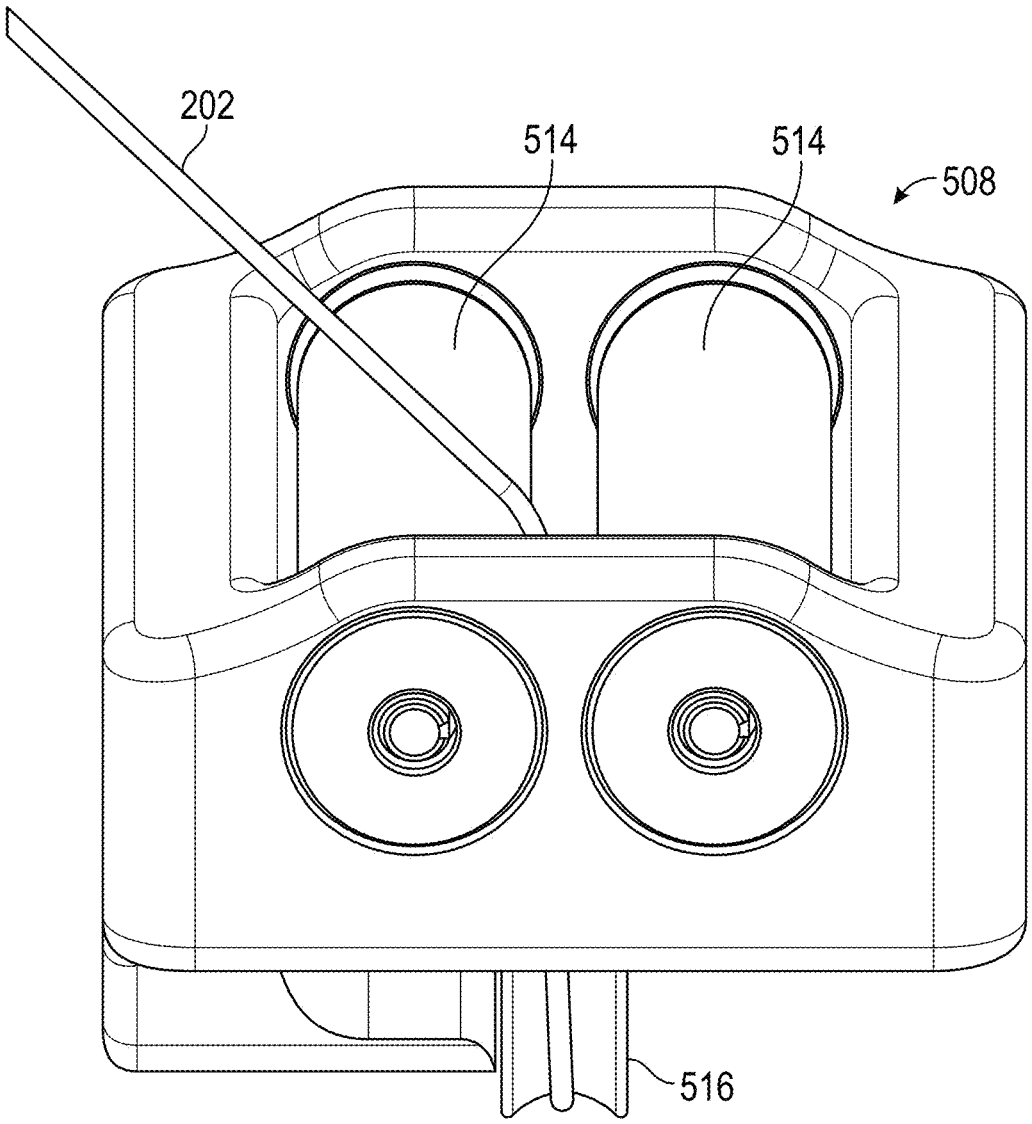
FIG. 8 is a side perspective view of the cable guide of FIG. 5 according to some examples.

FIG. 8 is a side perspective view of the cable guide 508 of FIG. 5 according to some examples. The arrangement of the pulley 516 below the gap between the roller 514 can clearly be seen in FIG. 8. Also, it can be seen that the rollers 514 permit the cable 202 to move functionally forward and backward over the exercise device 102 without it interfering with the housing. The arrangement of the rollers 514 and the pulley 516 ensure that the cable 202 can be moved not only in a vertical direction but also within a certain range of angles from the vertical in all four directions (left, right, forward, and backward).

Figure 9:
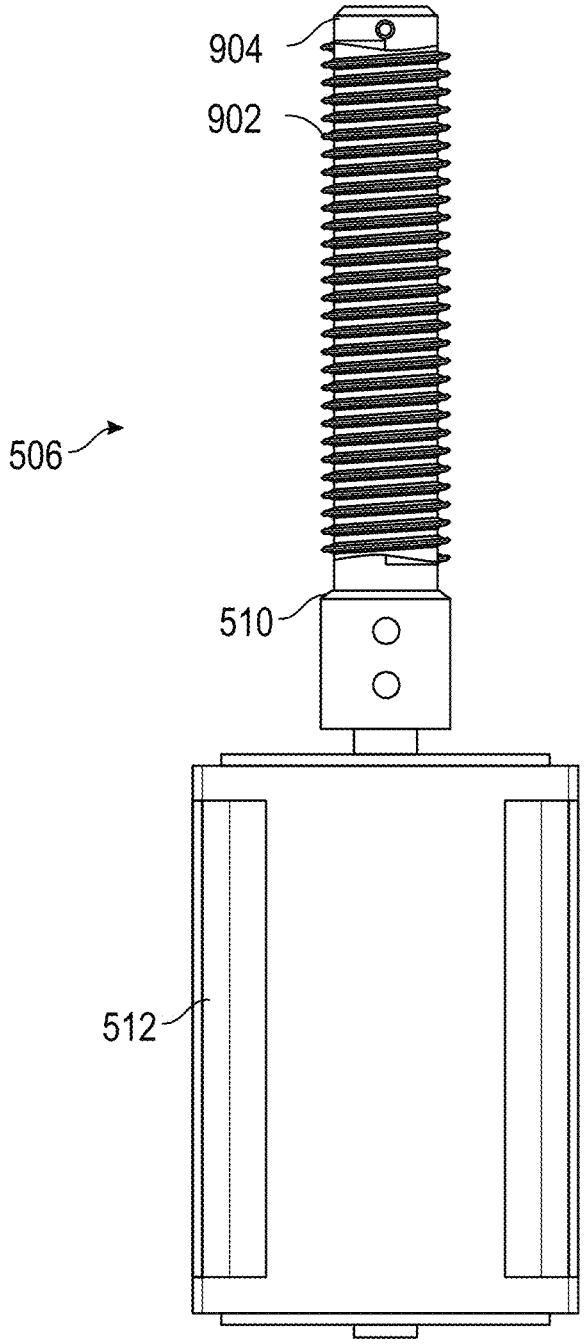
FIG. 9 is a top view of the retraction mechanism of FIG. 5 according to some examples.

FIG. 9 is a top view of the retraction mechanism 506 of FIG. 5 according to some examples. In use, the retractable cables wind and unwind on a long tubular threaded spool 510, which is coupled directly to the shaft of the motor 512, which is a brushless AC electric motor in some examples. The threaded spool 510 converts the torque and rotation of the motor 512 into tension and linear movement of the cable 202 in use.

A helical groove 902 on the threaded spool 510 is sized to receive the cable 202 and ensures that the cable 202 winds smoothly onto and off the threaded spool 510 without overlap. The cable 202 is secured at the far end 904 of the threaded spool 510 in some examples. The width of the groove 902 matches the nominal thickness of the cable 202. The helical groove in the spool can be clockwise or counterclockwise along the length looking from the direction of the motor, depending on the desired direction of rotation of the threaded spool 510. When fully retracted, approximately 9 feet of cable 202 is wound on the threaded spool 510 to provide enough cable length for a user with a height of 6 feet 6 inches and proportionally long arms to hold a bar 116 fully extended vertically above their head as shown in FIG. 3C.

To provide rapid responsiveness and natural feel under cable acceleration (for example when initiating a movement or during a directional change during a movement, it is desirable that the motor and the threaded spool 510 have relatively low rotational inertia. Furthermore, additional rotating components such as gears or pulleys or belts or chains, especially with substantial mass and a large outer diameter, will add to the net rotational inertia of a rotating mechanism. Gearboxes additionally have backlash (also known as play or slop), which refers to the angle that the output shaft of a gearhead can rotate without the input shaft moving. Backlash can create noise and reduce responsiveness. The use of a direct drive motor without any gears, pulleys or sprockets or belts or chains between the motor 512 and the threaded spool 510 provides a low moment of inertia without backlash between the motor 512 and the threaded spool 510. In some examples, the groove 902 may be fabricated directly into an extended shaft that protrudes from the motor 512.

The retraction mechanism 506 needs to create a relatively high force, for example up to 150 lbs on each cable 202, for a total maximum force of 300 lbs on the bar 116 in barbell mode. The maximum torque required can be determined by multiplying the required force by the radial distance from the center axis of the threaded spool 510 to the center of the cable 202 on the threaded spool 510. To create the required relatively high force, either the peak torque capacity of the motor 512 needs to be relatively high or the radius of spool needs to be relatively low. As the torque increases, motors become bigger, heavier and more expensive. To keep the cost and the weight of the exercise device 102 down, a light weight and low-torque motor is desirable, which requires that the radius of the threaded spool 510 be kept quite small, allowing relatively high force generation using a relatively small and low-torque motor.

As the radius of a conventional spool becomes smaller, problems can arise with the number of turns required to accommodate a long cable. This can result in the cable overlapping itself or require the provision of special winding mechanisms. To resolve these challenges, the threaded spool 510 is designed to an elongated rod or tube, with the length of the threaded spool 510 being defined by the length of cable wrapped in the helical groove of the spool. In some examples the length of the groove is a multiple (integer or non-integer) of at least twice its diameter.

With a spool having a thread to accommodate the cable, such as the threaded spool 510, the spool can become quite long to accommodate the approximately 9 feet of cable. A long spool can cause problems as the span between the cable being fully wound and fully unwound on the spool can become significant. There is also a certain limit to how wide (front to back) the exercise device 102 can be while still retaining a desirable form factor. Additionally, the platform 106 is quite low for user convenience, and does not itself provide sufficient room for a retractor mechanism. The dimensions of the threaded spool 510 will thus depend on a number of factors, including the width (front to back) of the exercise device 102, the desired size of the side pods 108, the bending forces that the threaded spool 510 will need to endure when the cable is under maximum design load at the far end 904 of the threaded spool 510, motor size, torque and speed requirements, and so forth.

In one example, with a maximum motor torque of 7 Nm, a cable length to unspool of 9 feet and a spool pitch of 4 mm, the required 150 lb. force can be generated with a spool having a diameter of 21 mm, with a helix length of 167 mm and an overall spool length of 219 mm to accommodate the cable length. In this case the spool length is thus approximately ten times the spool diameter, although it will be appreciated that other integer or non-integer multiples are possible. Preferably the spool length is at least five times the spool diameter, but no less than twice the spool diameter.

Figure 10:
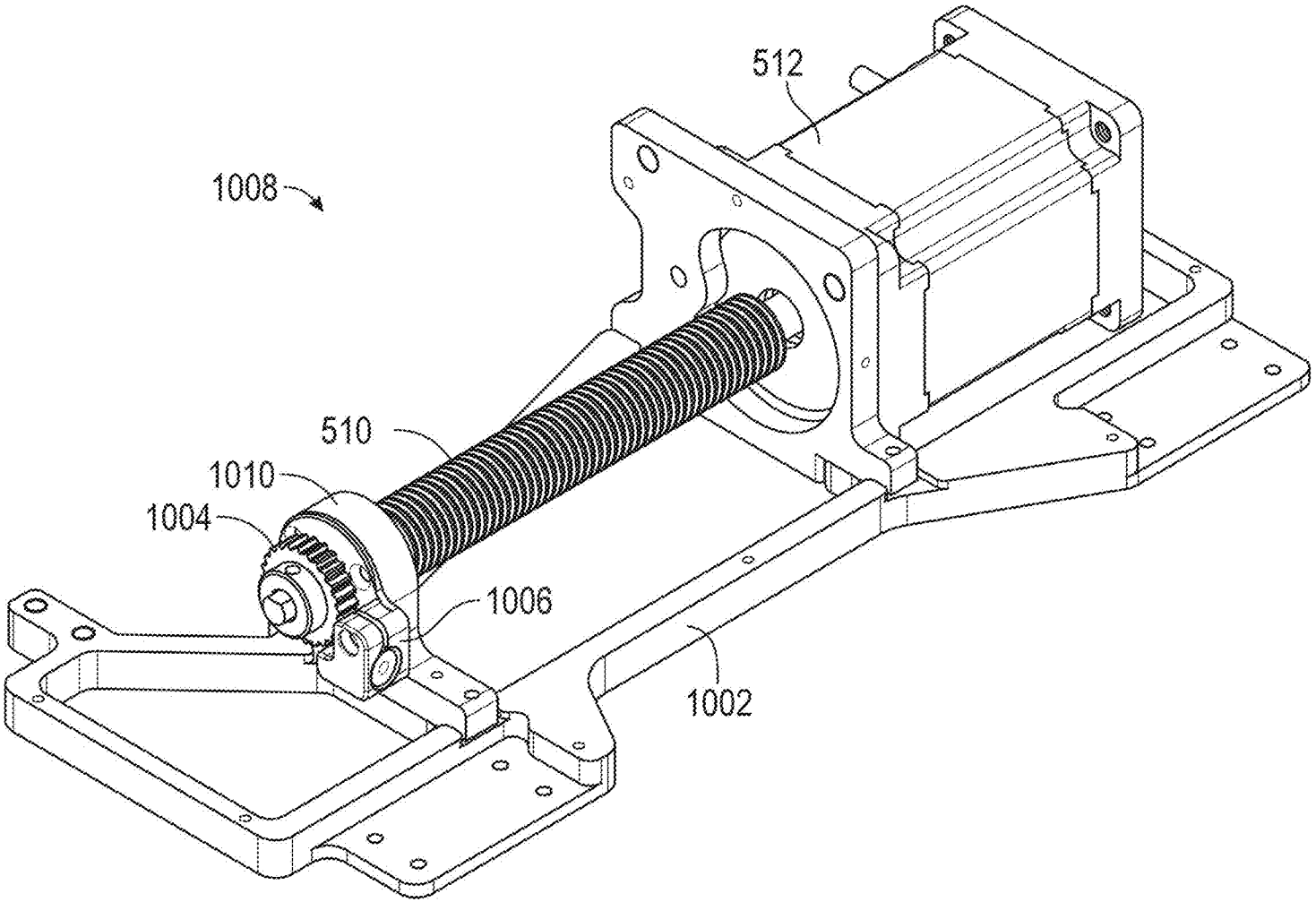
FIG. 10 is a perspective view of a retraction mechanism according to some examples.

FIG. 10 is a perspective view of a retraction mechanism 1008 according to some further examples. As before, the retractable cables wind and unwind on a long tubular threaded spool 510, which is coupled directly to the shaft of the motor 512, which is a brushless AC electric motor in some examples. The threaded spool 510 converts the torque and rotation of the motor 512 into tension and linear movement of the cable 202 in use. The motor 512 is mounted to a frame 1002, which is in turn mounted to a chassis of the exercise device 102/402. The end of the threaded spool 510 remote from the motor 512 is coupled to the frame 1002 by a bearing mounted in a bearing bracket 1010. This bearing reduces or eliminates bending forces on the threaded spool 510 and shaft 1202, which would otherwise have to be absorbed by the motor 512

Known exercise devices using an electric motor and a spool but are not powered by batteries, but need to always stay connected to a wall outlet to keep the end point of the cable, which may or may not be attached to a bar or handle, retracted when not in use. If the power is interrupted, the cable end can extend under the weight of a handle or bar, or can easily be pulled out. Additionally, if the device is left unpowered or powered down at the default minimal cable retraction force, a child can pull on the cable and risk entanglement. Some devices, when in the powered down state, can be powered up by pulling on the cord, which may result in an unexpected retraction force.

The retraction mechanism 1008 includes a locking safety mechanism 1006 that prevents withdrawal of a cable from the side pods 108/408 unless the exercise device is powered on and enabled. The safety mechanism 1006 is located outboard of the bearing bracket 1010, and enablement of the device is typically done by an adult through the set top box 1610 via the television remote control 1614 (see FIG. 16) or an application on the client device 1606 when the user wants to exercise, in conjunctions with other contextual factors as discussed in more detail below with reference to FIG. 14. The safety mechanism 1006 remains or enters a default locked position when not affirmatively activated or in the case of power loss to the exercise device 102/402 or to the retraction mechanism 1008, by engaging a ratchet wheel or gear 1004 mounted to the shaft of the motor 512.

The safety mechanism 1006 needs to be powered up by the embedded processor 1512 and the battery pack 1520 (see FIG. 15) to unlock the safety mechanism 1006, which ensures that the safety mechanism 1006 auto-locks the threaded spool 510 in case of a battery failure or fault event. An application on the set top box 1610 or the client device 1606 can also provide a signal to power down or auto-lock the safety mechanism 1006 in case of a timer expiry that triggers power down or entering a disabled state if the exercise device 102/402 is left unused for more than a specified time period.

Figure 11:
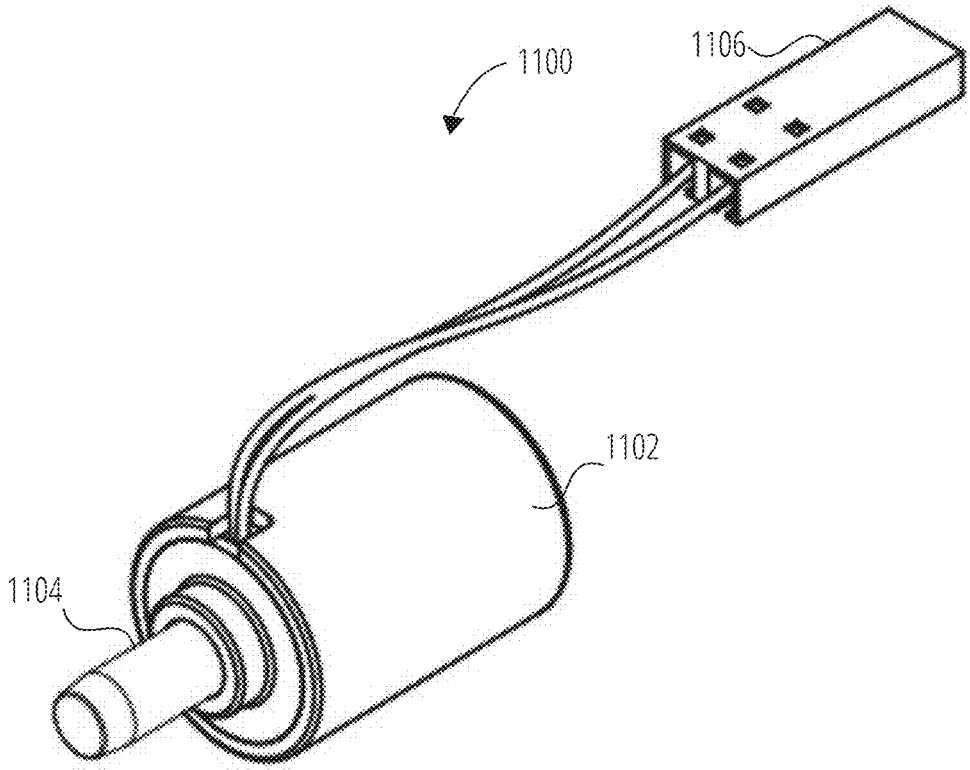
FIG. 11 is a perspective view of a solenoid for use in the safety mechanism of FIG. 10, according to some examples.

FIG. 11 is a perspective view of a solenoid 1100 for use in the safety mechanism 1006 of FIG. 10, according to some examples. The solenoid 1100, which is an example of an actuator suitable for use in the safety mechanism 1006, includes a housing 1102, a plunger 1104 and a connector 1106 with electrical terminals for use in activating and deactivating the solenoid 1100.

The housing 1102 includes a compression spring that acts on the plunger 1104 to push it out of the housing 1102 in a default (unpowered) state. The housing 1102 also includes a coil that generates a magnetic field that overcomes the spring resistance and retracts the plunger 1104 when power is applied to the solenoid 1100 via the terminals in the connector 1106.

Figure 12:
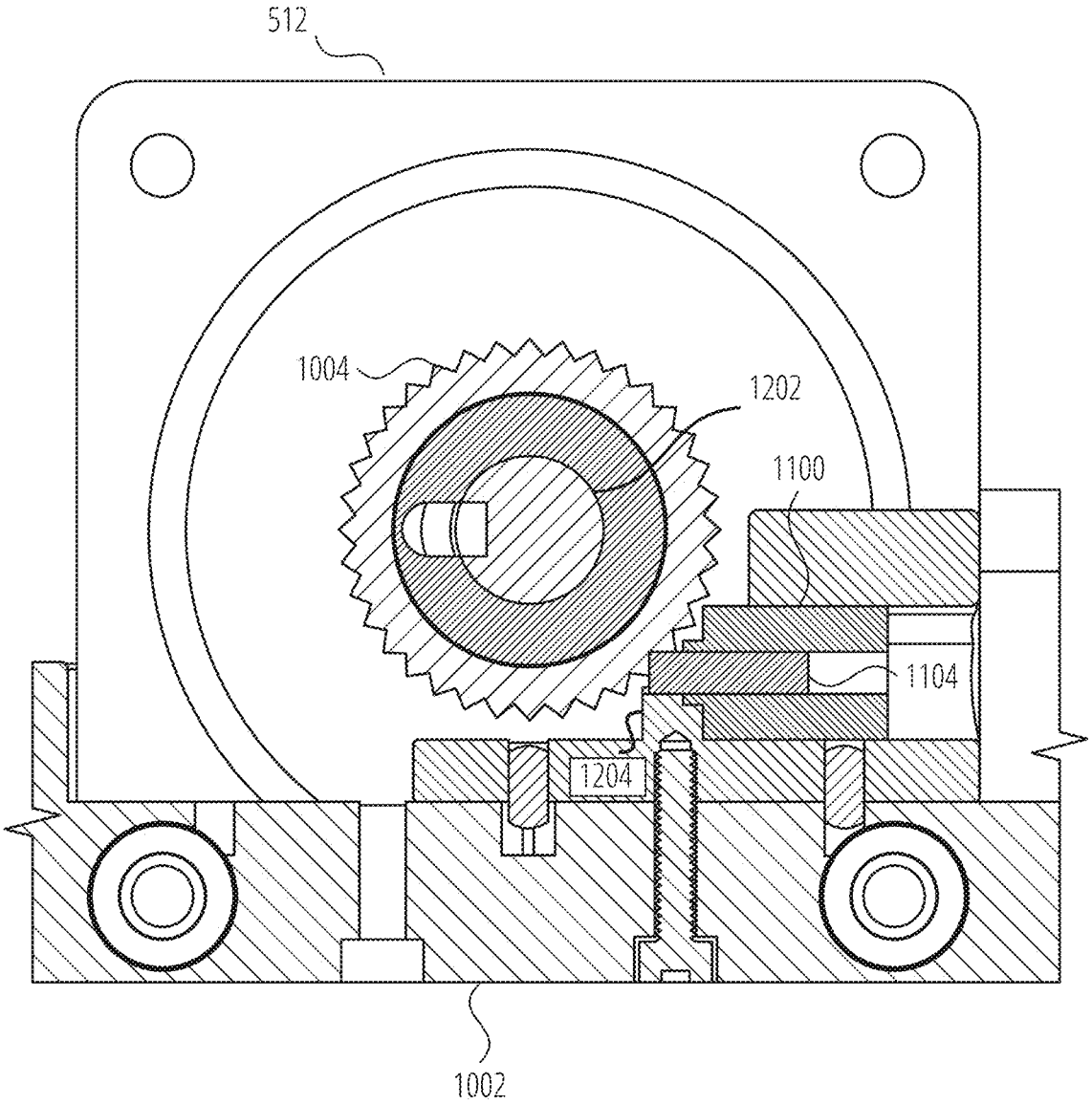
FIG. 12 is a partial cross sectional view of the safety mechanism and the retraction mechanism of FIG. 10 according to some examples.

FIG. 12 is a partial cross sectional view of the safety mechanism 1006 and the retraction mechanism 506 of FIG. 10 according to some examples. The safety mechanism 1006 is shown in its default (power off) position in FIG. 12. As can be seen, the gear 1004 is mounted to a shaft 1202 of the motor 512. The shaft 1202 is coupled to the threaded spool 510 as shown previously. The solenoid 1100 is mounted to the frame 1002 such that the plunger 1104 engages with the teeth of the gear 1004 as shown, when the solenoid 1100 is not receiving power and the plunger 1104 is thus extended from the solenoid housing 1102.

When the exercise device 102/402 is powered down, or power fails, or the device is disabled by a user from the client device 1606 or the set top box 1610, or auto-disables due to a time out event, the solenoid 1100 becomes de-energized. This removes the electromagnetic force that is holding the plunger 1104 in the housing 1102. The plunger 1104 is then pushed out of the housing 1102 by the spring in the solenoid 1100, thereby to engage the gear 1004.

The engagement of the plunger 1104 with the teeth of the gear 1004 prevents the gear 1004 from rotating in a clockwise direction, which corresponds to the direction that will spool out the cable (such as cable 202) from a side pod 108. When attempting to rotate in the clockwise direction, the gear 1004 pushes the plunger in a direction perpendicular to the axis of movement of the plunger 1104. The plunger is supported by a stop 1204 that is provided as part of the structure by which the solenoid 1100 is mounted to the frame 1002. Forces exerted by the gear 1004 when it attempts to rotate clockwise are thus initially absorbed by solenoid 1100, but progressively greater forces are absorbed by the stop 1204 and not by the solenoid 1100 itself.

When the gear 1004 moves in a counterclockwise direction, which corresponds to the direction that will spool the cable (such as cable 202) into a side pod 108, the teeth of the gear 1004 push the plunger 1104 back into the solenoid housing 1102 against the relatively weak force exerted by the spring, which permits the teeth to pass the plunger 1104 and the gear 1004 (and thus the shaft 1202) to rotate in a counterclockwise direction to permit retraction of the cable. The plunger 1104 and gear 1004 thus functions a ratchet and pawl mechanism when the solenoid 1100 is powered down. Any initial misalignment of the plunger 1104 and the gear 1004 is resolved as soon as the gear 1004 rotates in one direction or the other.

The solenoid 1100 used doesn't need to be large or powerful, or include a stiff spring, because there is little or no resistance to the extension of the plunger 1104 when power to the solenoid 1100 is removed. Additionally, when the device is activated, the motor provides a small default counterclockwise rotation bias that tends to keep the cable 202 retracted. The plunger 1104 will thus not be trapped against the stop 1204 by the gear 1004. The power consumption of the solenoid when energized to hold the plunger 1104 withdrawn during normal usage is low.

Figure 13:
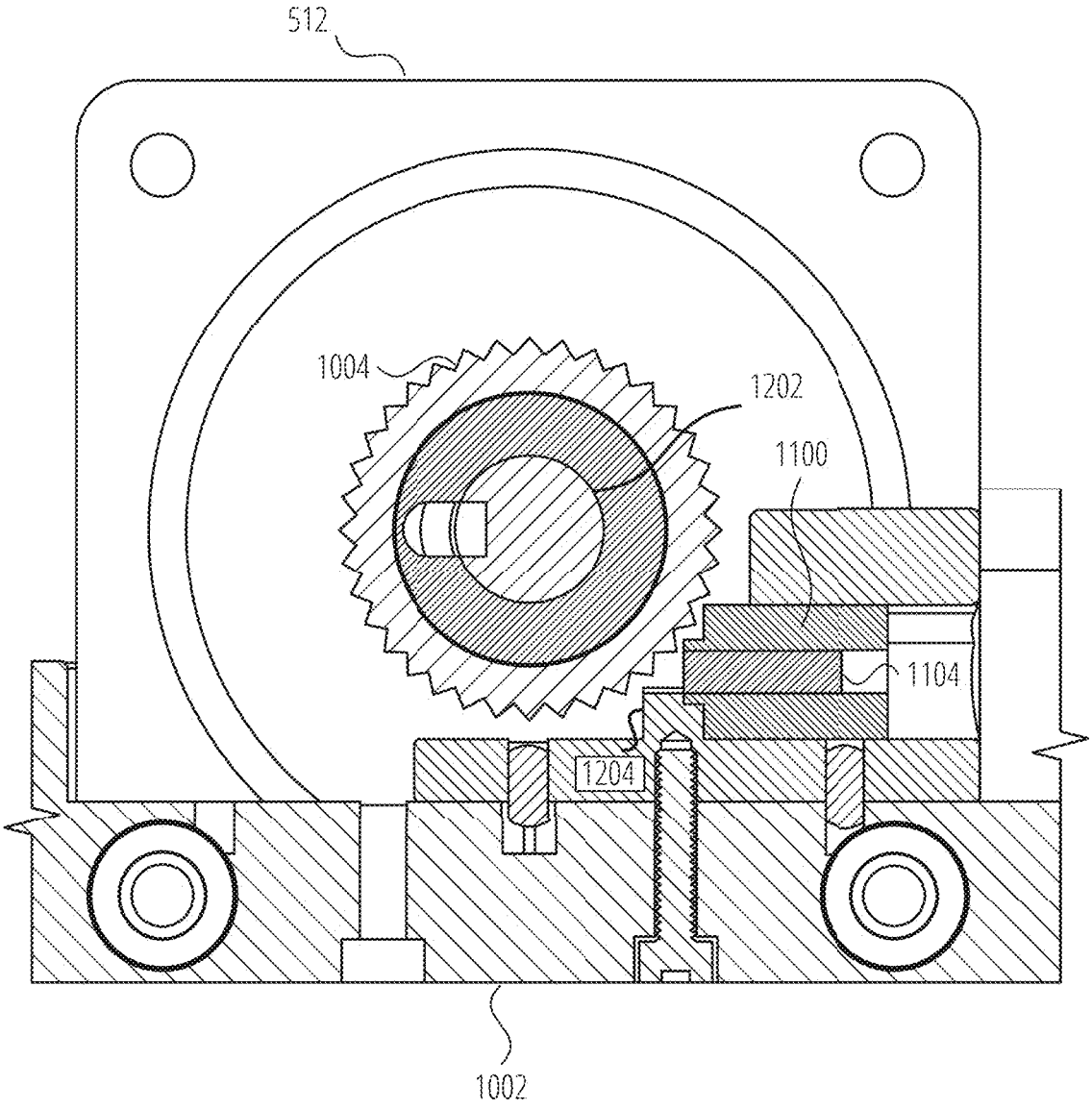
FIG. 13 is a partial cross sectional view of the safety mechanism and the retraction mechanism of FIG. 10 according to some examples.

FIG. 13 is a partial cross sectional view of the safety mechanism 1006 and the retraction mechanism 506 of FIG. 10 according to some examples. The safety mechanism 1006 is shown in its in-use (power on) position in FIG. 13.

As can be seen, when the exercise device 102/402 is enabled by a user from the client device 1606 or the set top box 1610, the solenoid 1100 is energized. This applies power to the coil in the solenoid 1100, which generates an electromagnetic force that overcomes the spring force tending to extend the plunger 1104 from the housing 1102. The plunger 1104 is thus withdrawn into the housing 1102 and out of engagement with the gear 1004.

When the plunger 1104 is withdrawn, the gear 1004 (and thus the shaft 1202 and the threaded spool 510 can rotate freely in both directions as if there was no safety mechanism 1006, and the user can use the exercise device 102/402 as intended.

The solenoid 1100 is driven by a MOSFET switch that is in turn controlled by a general purpose input-output (GPIO) pin on the embedded processor 1512 of the control system 1502. This allows for rapid software control to lock or unlock exercise device 102/402, while ensuring that the safety mechanism 1006 mechanism will always lock the exercise device 102/402 when the power fails, even without a signal from the embedded processor 1512.

It will thus be appreciated that the plunger functions as a latch, with a first position in which the cable 202 cannot be retracted and a second position in which the cable can be retracted. Other latching arrangements are also possible, including a ratchet and pawl or other mechanisms that can selectively obstruct and release movement of the cable 202.

Figure 14:
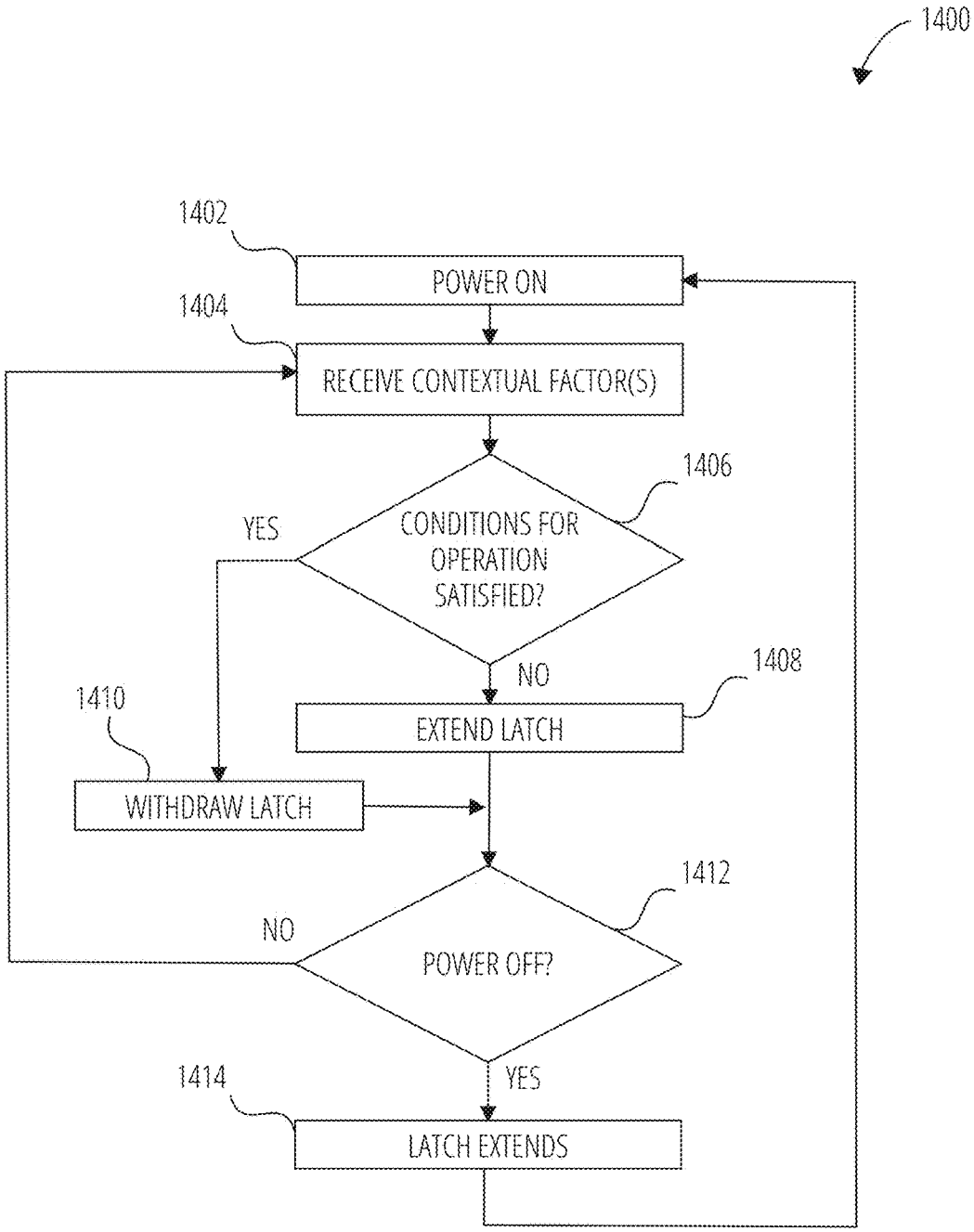
FIG. 14 is a flowchart illustrating a method of operating the exercise device according to some examples.

FIG. 14 is a flowchart 1400 illustrating a method of operating the exercise device 102 according to some examples. For explanatory purposes, the operations of the flowchart 1400 are described herein as occurring in serial, or linearly. However, multiple operations of the flowchart 1400 may occur in parallel. In addition, the operations of the flowchart 1400 need not be performed in the order shown and/or one or more blocks of the flowchart 1400 need not be performed and/or can be replaced by other operations. The operations of the flowchart 1400 may be controlled or performed by the embedded processor 1512 in the exercise device 102 (see FIG. 15), and/or by code running on one of the other devices in system 1600 (see FIG. 16), such as the client device 1606, the set top box 1610, the client device 1606, the server 1604 and so forth. In some cases the devices may work together to perform the method. For example, an interactive exercise program running on the server 1604, the client device 1606 or the set top box 1610 may receive inputs representing contextual factors, such as user input to start an exercise session, or an indication of the presence of a user on the exercise device 102 from the exercise device 102, which may then provide an instruction to the embedded processor 1512 to retract the plunger 1104 from the gear 1004.

The method starts at operation 1402 with the exercise device 102 being powered on. In this initial state, the solenoid 1100 is not receiving power and the plunger 1104 is in its extended state, preventing rotation of the gear 1004. In operation 1404 one or more contextual factors are received and/or determined. Some examples of contextual factors include the expiry of an inactivity timer, such that if the user leaves the device ON and walks away, the cables 202 lock after a set period of time, such as 30 seconds. Detection or notification of a device fault triggered due to a low battery level, or detected reported by fault sensors in the position encoders 1506, 1510, load cells under the platform 106, 412, current sensors, and so forth will also result in the release of the plunger 1104 to lock the gear 1004.

In other examples, when the exercise device 102 is hooked to charger, the plunger 1104 is released as part of a lower power mode during charging, as power is consumed to keep the plunger 1104 withdrawn to unlock the exercise device 102. This also prevents use of the device workout while the battery charger is connected.

Another example of a contextual factor is detection that that a cable 202 is pulled out of the exercise device 102 to a certain maximum limit, extension beyond which can damage the point of attachment of the cable 202 to its threaded spool 510 and can also dislodge the cable 202 from the threads of the threaded spool 510. If the extension of the cable 202 to this maximum limit is detected, the plunger 1104 is released to prevent further extension of the cable 202. At the maximum limit, there will still be 2-3 turns of cable 202 wound on the threaded spool.

In some examples, the contextual factors include detection of a user standing on the platform 106 of exercise device 102 using load cells under the platform 106, 412, and initiation or termination of an exercise routine by a user to release or lock the gear 1004 respectively. It will of course be appreciated that the contextual factors will each be considered in a cumulative manner, such that all enabling contextual factors are required to be met to permit use of the exercise device 102, while only a single disabling contextual factor is required to be met to prevent use of the exercise device 102. Furthermore, as discussed above, if power fails for any reason, such as due to wiring damage or the battery pack 1520 being disengaged, the exercise device 102 will be locked automatically due to the bias of the plunger 1104 into the extended position.

In operation 1406, the one or more contextual factors are assessed to determine if conditions for operating the exercise device 102 have been met. If the conditions have been met, the flowchart 1400 proceeds to operation 1410 and the latch (plunger 1104 in some examples) is withdrawn to permit rotation of the gear 1004 and thus permit operation of the device. If conditions for operation are not met in operation 1406, the latch (plunger 1104) is extended in operation 1408 if it is not already extended, in operation 1408. Extension of the plunger 1104 is accomplished by removing power to the solenoid 1100.

In operation 1412 if the exercise device 102 remains powered on, the flowchart 1400 returns to operation 1404 for continued receipt and monitoring of the one or more contextual factors, and the method proceeds from there.

If the exercise device 102 is powered off in operation 1412, for whatever reason, the latch (plunger 1104) extends automatically in operation 1414 to lock the exercise device 102. The flowchart 1400 then restarts at operation 1402 when the exercise device 102 is powered on again.

Figure 15:
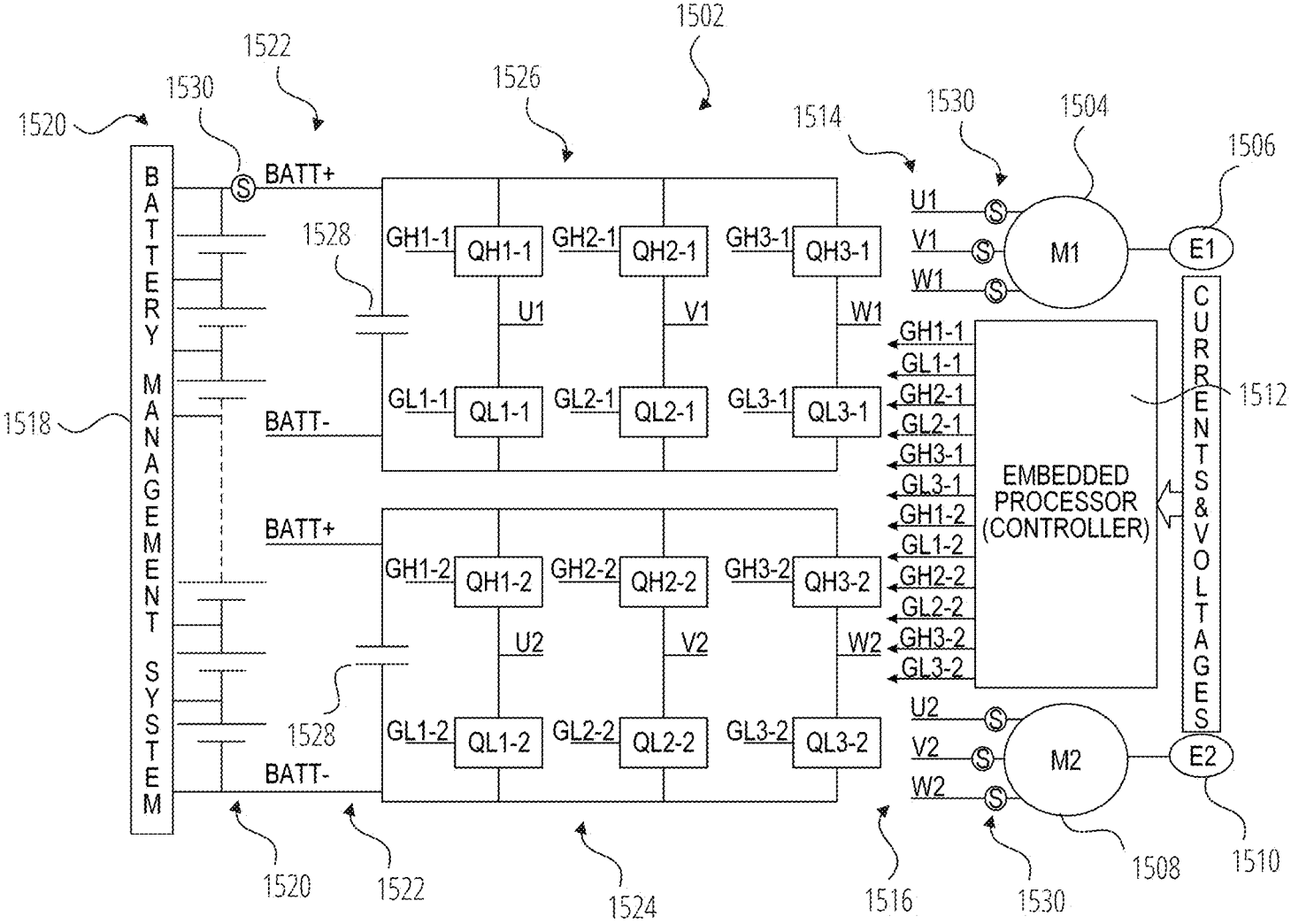
FIG. 15 illustrates an electrical control system and related components for the exercise device according to some examples.

FIG. 15 illustrates an electrical control system 1502 and related components for the exercise device 102 according to some examples. Illustrated in FIG. 15 are a left motor 1504 with a left encoder 1506 and left motor terminals 1514, a right motor 1508 with a right encoder 1510 and right motor terminals 1516, an embedded processor (microcontroller) 2012, a rechargeable battery pack 1520 with a battery management system 1518, and a left motor hex bridge inverter 1526 and a right motor hex bridge inverters 1524. The battery terminals 1522 are coupled to the hex bridge inverter 1524 and hex bridge inverter 1526, which are in turn coupled to the left motor terminals 1514 and right motor terminals 1516 respectively. The hex bridge inverter 1526 and hex bridge inverter 1524 are each independently controlled by the embedded processor 1512 to provide a current through each motor that will generate a required torque in the left motor 1504 and right motor 1508 respectively.

The control system 1502 for an AC motor is often called as an inverter as it takes DC voltage and coverts it into three phase AC voltage that then drives the AC motor. The control system 1502 comprises a dual inverter that can independently drive the left motor 1504 and right motor 1508. The embedded processor 1512 manages the exercise device 102 using seven sensors 1530 for current and voltage (one on each winding of each motor and one on the DC input bus current), a left encoder 1506 for the left motor 1504 and a right encoder 1510 for the right motor 1508. The embedded processor 1512 sends pulse-width modulation signal commands separately to the hex bridge inverter 1524 and hex bridge inverter 1526, each of which comprise 6 electronic MOSFET switches.

The DC inputs from the battery terminals 1522 to the hex bridge inverter 1526 and hex bridge inverter 1524 each include a DC link capacitor 1528 to reduce higher frequency voltage and current ripple. If the PWM frequency is less than 20 khz, audible motor noise may be created due to the creation of vibrations at frequencies that are audible to humans. Accordingly, the PWM frequency used by the embedded processor 1512 is greater than 20 kHz and can for example fall within a range of 30-60 khz. Higher PWM frequencies also create cleaner sinusoidal current waveforms with less torque ripple in low inductance motors, which can further reduce audible noise and improves motor efficiency. Motors that have quicker responses will often have very low inductance and are desirable in an application like this to provide quick responsiveness. The switching losses in the MOSFET switches increases with higher PWM frequencies, hence the gate drive circuit for each MOSFET is designed carefully in the PCB layout and configured to reduce gate ringing and switching losses in the MOSFETs To provide a DC input power source, a battery pack 1520 is used instead of a DC power supply. In use, the exercise device 102 may draw high power from the battery pack 1520 for short periods of time during movement of the bar 116 or handles 114 in one direction, with a quick return to low power or no power when moving in the other direction. The power draw is usually higher while the cable 202 is being retracted, compared to when the cable 202 is being withdrawn. Each motor may act as generator while the user is lifting the bar 116 or a handle 114, thus consuming low power or even negative power. Negative power draw means that current tends to flow back from the motor to the inverter and the DC power source.

Standard DC power supplies that run off the electrical grid are normally unable to receive current or power in such situations as they are usually unidirectional by design. Hence, the excess power is diverted to power resistors to dissipate as heat. If the excess power is not diverted, the DC bus voltage in the DC link capacitors 1528 can rise to dangerous levels leading to permanent damage to the capacitors and/or the MOSFETs and/or the power supply. Bidirectional power supplies exist that return power to the electrical grid, but they are heavy and expensive.

Using a battery pack 1520 as the power source permits power to be returned to the battery pack 1520, which avoids the need for power resistors, keeps the exercise device 102 cooler and also proves to be energy efficient. Additionally, battery packs 1520 are good at providing high current levels for short periods of time due to their lower internal resistance. The size and cost of the battery is thus not defined by the peak power requirement but instead by the total energy consumed. Hence, using a battery pack 1520 instead of a DC power supply can make the exercise device 102 cheaper and lighter. The size and cost of a DC power supply is defined by the peak power requirement, which makes them heavier and expensive.

Additionally, use of the exercise device 102 is made more convenient and flexible by providing a battery pack 1520 instead of a DC power supply, which needs a thick power cord connected to the power outlet, that brings high voltage AC down to the device and corresponding safety concerns especially the risk of an electric shock in case of a fault. A long power cord or extension cord can also act as a trip hazard. A small low voltage DC output trickle charger can be used that slowly charges the battery pack 1520 over a period of time when the device is not in use. The relatively higher voltage from the power outlet just goes to the trickle charger and not the exercise device 102. The charger module can be a wall outlet mount module that may have already been certified. The battery management system 1518 keeps track of the voltages in the cells of the battery pack 1520 during charging and ensures that all cells are evenly charged. The battery management system 1518 systems keeps track of the battery voltage and disables the exercise device 102 if the battery is almost fully discharged, to protect the battery from permanent damage that may result from over discharging.

Figure 16:
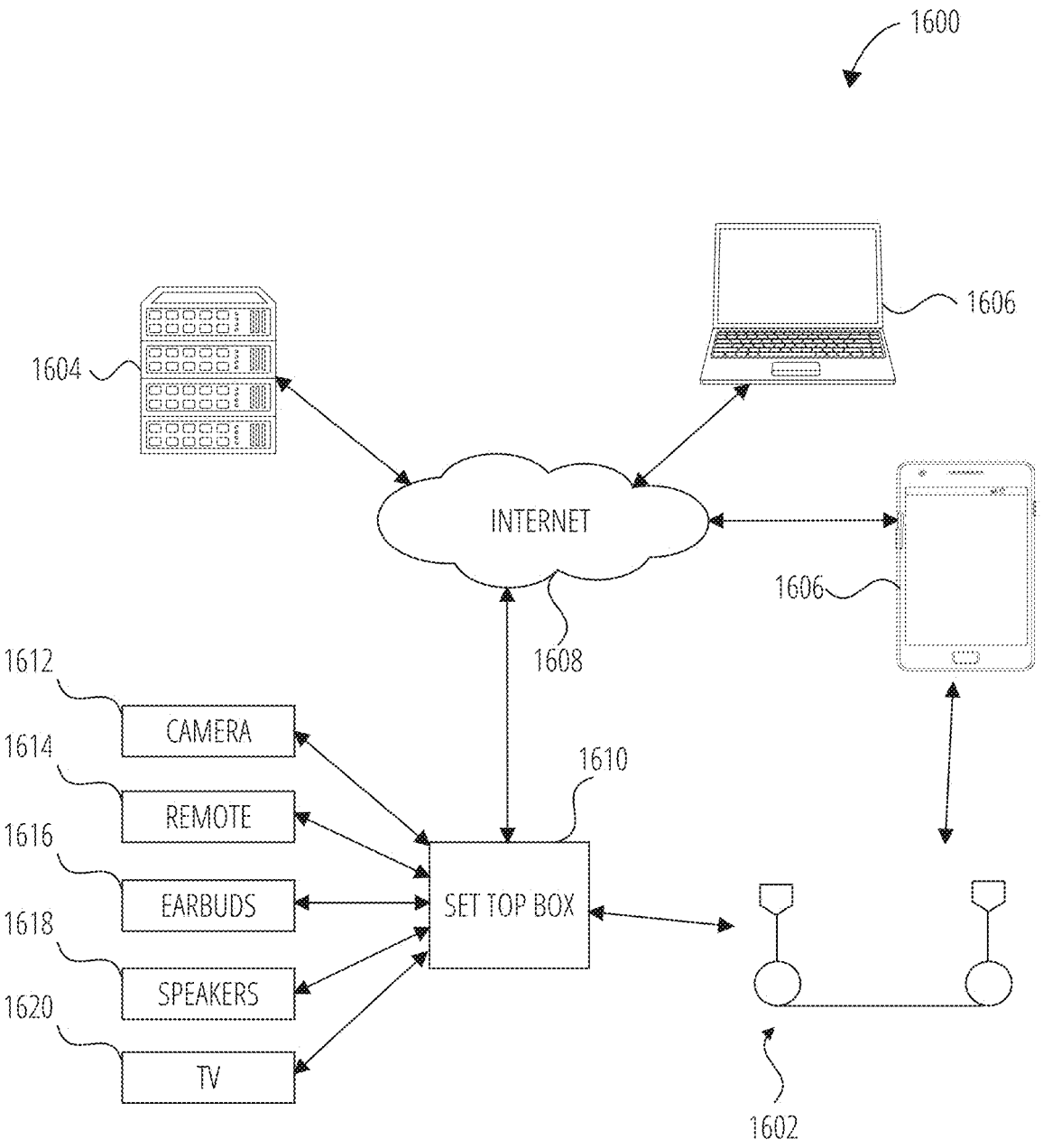
FIG. 16 illustrates a system including an exercise device, a server, and various client devices according to some examples.

The left encoder 1506 and the right encoder 1510 are each multi-turn type encoders that keep track of rotational position changes beyond 360 degrees and they are thus able to provide an output that is proportional to length of unspooled cable 202 outwards on both sides of the exercise device 102. This permits measurement of the height of the bar 116 or handle 114 above the platform 106. When using a traditional barbell, for exercises like an overhead press, the user needs to first place the barbell on the studs of a squat rack at a certain height and has to load the weights onto the barbell before the exercise can be performed. This ensures the force start point is set at the certain height above the floor and the exercise is always performed at a height above this start point. The user can also easily return the barbell to the squat rack at end of the exercise or during the exercise if they are struggling, without risking injury. But it can still be risky or inconvenient, if the user lowers the bar below the height of the studs during the exercise FIG. 16 illustrates a system 1600 including an exercise device 1602, a server 1604, and client devices 1606 according to some examples. In various examples, the client devices 1606 may include desktop PCs, mobile phones, laptops, tablets, wearable computers, smart televisions or other computing devices that are capable of connecting to the Internet 1608 and communicating with the server 1604, such as described herein. The client device 1606 may be paired with the exercise device 1602 using a Bluetooth connection, to provide a user interface by means of which a user of the exercise device 1602 can manage the exercise device 1602, as well as to receive feedback on their use of the exercise device 1602.

A mobile phone or a tablet computer may be a suitable client device 1606 for use with the exercise device 1602, since these devices have a touch screen for display and user input, a Bluetooth adapter for communication with the exercise device 1602, a Wi-Fi adapter for connection to the Internet 1608, and a camera and microphone for video communication. An application running on a mobile phone or tablet computer can thus do all the data processing, relaying of logged data to the server 1604, as well as streaming of video or other audio content from the internet, and communicating with the users of other exercise devices 1602 or with remote personal trainers. Such an application can also be used to control the exercise device 1602 to select exercise types and levels, select different user profiles for the exercise device 1602, and track and display information about the user's current session and overall progress.

Another suitable device for use with the exercise device 1602 is a set top box 1610 with an associated television 1620 or monitor. The set top box 1610 is a smart, internet-connected device with an inbuilt computer capable of running an application to provide the capabilities described above with reference to the client device 1606. Some examples of such a set-top box are Amazon Fire TV cube, Amazon fire TV stick, Google Chromecast TV, and so forth. The television 1620 may also be a smart television that has set top box functionality built in, in which case a separate set top box 1610 may not be required.

The set top box 1610 provides a video signal to the TV over HDMI or other display protocol. The set top box 1610 and/or a smart television 1620 may be preferred over a smartphone or a tablet because they can be controlled by a remote control 1614 that can be used from a distance, provide a larger display, and may be easier to use, especially for the elderly. Wireless connectivity like Bluetooth, Wi-Fi, etc. are typically available on current smart televisions or set-top boxes, or can be easily added via a USB interface. Such connections can again be used to exchange data between remote servers 1604, the exercise device 1602 and to communicate with workout partners or personal trainers over the Internet 1608

For video communication, a camera 1612 may be in-built into the set-top set top box 1610 or the television 1620 TV. Alternatively, a camera with a wired USB interface can be connected to a USB interface on the set-top set top box 1610 or smart television 1620. Audio output can be provided by earbuds 1616 connected to the set top box 1610 or the smart television 1620, or by wired or wireless speakers 1618. A microphone may be built into the camera, the set-top box, may be connected to the set-top set top box 1610 via USB, or be included in wireless earbuds connected through Bluetooth.

Various examples are contemplated. Example 1 is an exercise device, comprising: a cable; an electromagnetic retraction mechanism for spooling the cable into the exercise device, the electromagnetic retraction mechanism including a shaft; a gear coupled to the shaft; a latch movable between an extended position in which it engages the gear to prevent rotation of the gear in one direction, and a retracted position in which the latch does not engage the gear; an actuator to move the latch to the retracted position when the actuator is powered on; and a spring to move the latch into the extended position when power to the actuator is removed.

In Example 2, the subject matter of Example 1 includes, wherein the gear can rotate past the latch in a direction that is opposite to the one direction, when the latch is in the extended position.

In Example 3, the subject matter of Example 2 includes, wherein the electromagnetic retraction mechanism provides a bias to spool the cable into the exercise device when the latch is in the extended position.

In Example 4, the subject matter of Examples 1-3 includes, a control mechanism to selectively apply or remove power to the actuator based on one or more contextual factors.

In Example 5, the subject matter of Example 4 includes, wherein the one or more contextual factors include detection of a user on the exercise device.

In Example 6, the subject matter of Examples 4-5 includes, wherein the one or more contextual factors include initiation or termination of an exercise session by a user.

In Example 7, the subject matter of Examples 4-6 includes, wherein the one or more contextual factors include expiry of an inactivity timer.

In Example 8, the subject matter of Examples 4-7 includes, wherein the one or more contextual factors include detection or notification of a device fault.

In Example 9, the subject matter of Examples 4-8 includes, wherein the one or more contextual factors include the exercise device being in a charging state.

In Example 10, the subject matter of Examples 4-9 includes, wherein the one or more contextual factors include extension of the cable to or beyond a maximum limit.

In Example 11, the subject matter of Examples 1-10 includes, wherein the actuator comprises a solenoid and the latch comprises a plunger movable in use by the solenoid.

Example 12 is a method of operating an exercise device, comprising a cable, an electromagnetic retraction mechanism for spooling the cable into the exercise device, the electromagnetic retraction mechanism including a shaft; a latch movable between an extended position in which it prevents rotation of the shaft in one direction, and a retracted position in which the latch permits rotation in the one direction; and an actuator to move the latch to the retracted position when the actuator is powered on, the method comprising: detecting one or more contextual factors relating to a user of the exercise device; and controlling the actuator to either prevent or permit the rotation of the shaft in the one direction based on the one or more detected contextual factors.

In Example 13, the subject matter of Example 12 includes, wherein the one or more contextual factors include detection of a user on the exercise device, and the controlling of the actuator comprises moving the latch into the retracted position.

In Example 14, the subject matter of Examples 12-13 includes, wherein the one or more contextual factors include initiation or termination of an exercise routine by a user.

In Example 15, the subject matter of Examples 12-14 includes, wherein the one or more contextual factors include expiry of an inactivity timer.

In Example 16, the subject matter of Examples 12-15 includes, wherein the one or more contextual factors comprise detection or notification of a device fault.

Example 17 is a non-transitory computer-readable storage medium, the computer-readable storage medium including instructions that when executed by a computer, cause the computer to perform operations for operating an exercise device, comprising a cable, an electromagnetic retraction mechanism for spooling the cable into the exercise device, the electromagnetic retraction mechanism including a shaft; a latch movable between an extended position in which it prevents rotation of the shaft in one direction, and a retracted position in which the latch permits rotation in the one direction; and an actuator to move the latch to the retracted position when the actuator is powered on, the operations comprising: detecting one or more contextual factors relating to a user of the exercise device; and controlling the actuator to either prevent or permit the rotation of the shaft in the one direction based on the detected the one or more contextual factors.

In Example 18, the subject matter of Example 17 includes, wherein the one or more contextual factors include detection of a user on the exercise device and initiation of an exercise session by a user.

In Example 19, the subject matter of Examples 17-18 includes, wherein the one or more contextual factors comprise extension of the cable to or beyond a maximum limit.

In Example 20, the subject matter of Examples 17-19 includes, wherein the one or more contextual factors include the exercise device being in a charging state.

Example 21 is at least one machine-readable medium including instructions that, when executed by processing circuitry, cause the processing circuitry to perform operations to implement of any of Examples 1-20.

Example 22 is an apparatus comprising structure to implement of any of Examples 1-20.

Example 23 is a system to implement of any of Examples 1-20.

Example 24 is a method to implement of any of Examples 1-20.

As referred to herein, the term non-transitory machine-readable medium refers to a single or multiple storage devices and/or media (e.g., a centralized or distributed database, and/or associated caches and servers) that store executable instructions and/or data. The terms shall accordingly be taken to include, but not be limited to, solid-state memories, and optical and magnetic media, including memory internal or external to processors. Specific examples of machine-storage media, computer-storage media and/or device-storage media include non-volatile memory, including by way of example semiconductor memory devices, e.g., erasable programmable read-only memory (EPROM), electrically erasable programmable read-only memory (EEPROM), FPGA, and flash memory devices (external or internal to processor); magnetic disks such as internal hard disks and removable disks; magneto-optical disks; and CD-ROM and DVD-ROM disks.

Changes and modifications may be made to the disclosed examples without departing from the scope of the present disclosure. These and other changes or modifications are intended to be included within the scope of the present disclosure, as expressed in the following claims as filed or amended.

What is claimed is:

1. An exercise device, comprising:

a cable;

a platform;

an electromagnetic retraction mechanism for spooling the cable into the exercise device and to provide a force on the cable towards the platform in use, against which a user exercises, the electromagnetic retraction mechanism including a shaft;

a gear coupled to the shaft;

a latch movable between an extended position in which the latch engages the gear to prevent rotation of the gear in a first direction that withdraws the cable from the exercise device, and a retracted position in which the latch does not engage the gear;

an actuator to move the latch to the retracted position when the actuator is powered on;

a spring to move the latch into the extended position when power to the actuator is removed; and a control mechanism including one or more data processors, to selectively apply or remove power to the actuator based on detection of one or more contextual factors by the one or more data processors, wherein the one or more contextual factors include detection of a user on the platform of the exercise device.

2. The exercise device of claim 1, wherein the gear is arranged to rotate past the latch in a second direction that is opposite to the first direction, when the latch is in the extended position.

3. The exercise device of claim 2, wherein the electromagnetic retraction mechanism provides a bias to spool the cable into the exercise device when the latch is in the extended position.

4. The exercise device of claim 1, wherein the one or more contextual factors include initiation or termination of an exercise session by input received by the one or more processors from a user.

5. The exercise device of claim 1, wherein the one or more contextual factors include expiry of an inactivity timer set by the one or more data processors.

6. The exercise device of claim 1, wherein the one or more contextual factors include detection or notification of a device fault.

7. The exercise device of claim 1, wherein the actuator comprises a solenoid and the latch comprises a plunger movable in use by the solenoid.

8. A non-transitory computer-readable storage medium, the computer-readable storage medium including instructions that when executed by a computer, cause the computer to perform operations for operating an exercise device, the exercise device comprising a cable, a platform, an electromagnetic retraction mechanism for spooling the cable into the exercise device and to provide a force on the cable towards the platform in use, against which a user exercises, the electromagnetic retraction mechanism including a shaft; a latch movable between an extended position in which the latch prevents rotation of the shaft in a first direction that withdraws the cable from the exercise device, and a retracted position in which the latch permits rotation in the first direction; and an actuator to move the latch to the retracted position when the actuator is powered on, the operations comprising:

detecting, by the computer, one or more contextual factors relating to a user of the exercise device; and controlling the actuator to either prevent or permit the rotation of the shaft in the first direction based on the detected one or more contextual factors, wherein the one or more contextual factors include detection of a user on the platform of the exercise device and initiation of an exercise session by a user.

9. The non-transitory computer-readable storage medium of claim 8, wherein the one or more contextual factors include expiry of an inactivity timer set by the computer.

10. An exercise device, comprising:

a cable;

a platform;

an electromagnetic retraction mechanism for spooling the cable into the exercise device and to provide a force on the cable towards the platform in use, against which a user exercises, the electromagnetic retraction mechanism including a shaft;

a gear coupled to the shaft;

a latch movable between an extended position in which the latch engages the gear to prevent rotation of the gear in a first direction that withdraws the cable from the exercise device, and a retracted position in which the latch does not engage the gear;

an actuator to move the latch to the retracted position when the actuator is powered on;

a spring to move the latch into the extended position when power to the actuator is removed; and a control mechanism including one or more data processors, to selectively apply or remove power to the actuator based on detection of one or more contextual factors by the one or more data processors, wherein the one or more contextual factors include the exercise device being in a battery charging state.

11. An exercise device, comprising:

a cable;

a platform;

an electromagnetic retraction mechanism for spooling the cable into the exercise device and to provide a force on the cable towards the platform in use, against which a user exercises, the electromagnetic retraction mechanism including a shaft;

a gear coupled to the shaft;

a latch movable between an extended position in which the latch engages the gear to prevent rotation of the gear in a first direction that withdraws the cable from the exercise device, and a retracted position in which the latch does not engage the gear;

an actuator to move the latch to the retracted position when the actuator is powered on;

a spring to move the latch into the extended position when power to the actuator is removed; and a control mechanism including one or more data processors, to selectively apply or remove power to the actuator based on detection of one or more contextual factors by the one or more data processors, wherein the one or more contextual factors include extension of the cable to or beyond a maximum limit.

12. A non-transitory computer-readable storage medium, the computer-readable storage medium including instructions that when executed by a computer, cause the computer to perform operations for operating an exercise device, the exercise device comprising a cable, a platform, an electromagnetic retraction mechanism for spooling the cable into the exercise device and to provide a force on the cable towards the platform in use, against which a user exercises, the electromagnetic retraction mechanism including a shaft; a latch movable between an extended position in which the latch prevents rotation of the shaft in a first direction that withdraws the cable from the exercise device, and a retracted position in which the latch permits rotation in the first direction; and an actuator to move the latch to the retracted position when the actuator is powered on, the operations comprising:

detecting, by the computer, one or more contextual factors relating to a user of the exercise device; and controlling the actuator to either prevent or permit the rotation of the shaft in the first direction based on the detected one or more contextual factors, wherein the one or more contextual factors comprise extension of the cable to or beyond a maximum limit.

13. A non-transitory computer-readable storage medium, the computer-readable storage medium including instructions that when executed by a computer, cause the computer to perform operations for operating an exercise device, the exercise device comprising a cable, a platform, an electromagnetic retraction mechanism for spooling the cable into the exercise device and to provide a force on the cable towards the platform in use, against which a user exercises, the electromagnetic retraction mechanism including a shaft; a latch movable between an extended position in which the latch prevents rotation of the shaft in a first direction that withdraws the cable from the exercise device, and a retracted position in which the latch permits rotation in the first direction; and an actuator to move the latch to the retracted position when the actuator is powered on, the operations comprising:

detecting, by the computer, one or more contextual factors relating to a user of the exercise device; and controlling the actuator to either prevent or permit the rotation of the shaft in the first direction based on the detected one or more contextual factors, wherein the one or more contextual factors include the exercise device being in a battery charging state.

* * * * *